US008508548B2

(12) United States Patent
Brown Elliott et al.

(10) Patent No.: US 8,508,548 B2
(45) Date of Patent: Aug. 13, 2013

(54) SUBPIXEL RENDERING AREA RESAMPLE FUNCTIONS FOR DISPLAY DEVICE

(75) Inventors: Candice Hellen Brown Elliott, Santa Rosa, CA (US); Michael Francis Higgins, Duncan Mills, CA (US)

(73) Assignee: Samsung Display Co., Ltd. (KR)

( * ) Notice: Subject to any disclaimer, the term of this patent is extended or adjusted under 35 U.S.C. 154(b) by 952 days.

(21) Appl. No.: 12/596,836

(22) PCT Filed: Apr. 16, 2008

(86) PCT No.: PCT/US2008/060515

§ 371 (c)(1), (2), (4) Date: Oct. 20, 2009

(87) PCT Pub. No.: WO2008/131027

PCT Pub. Date: Oct. 30, 2008

(65) Prior Publication Data

US 2010/0045695 A1 Feb. 25, 2010

(51) Int. Cl.
*G09G 5/00* (2006.01)

(52) U.S. Cl.
USPC ..... 345/613; 382/263

(58) Field of Classification Search
USPC ..... 345/613; 382/263
See application file for complete search history.

(56) References Cited

U.S. PATENT DOCUMENTS

| | | | |
|---|---|---|---|
| 2003/0034992 | A1 | 2/2003 | Brown Elliott et al. |
| 2005/0082990 | A1 | 4/2005 | Brown Elliott |
| 2006/0175530 | A1 | 8/2006 | Wilcox et al. |

OTHER PUBLICATIONS

International Search Report dated Aug. 11, 2008 corresponding to International Application No. PCT/US2008/060515.

*Primary Examiner* — Maurice L McDowell, Jr.
(74) *Attorney, Agent, or Firm* — Innovation Counsel LLP

(57) ABSTRACT

Input image data indicating an image is rendered to a display panel in a display device or system that is substantially configured with a three primary color or multi-primary color subpixel repeating group using a subpixel rendering operation based on area resampling techniques. Examples of expanded area resample functions have properties that maintain color balance in the output image and, in some embodiments, are evaluated using an increased number of input image sample points farther away in distance from the subpixel being reconstructed than in prior disclosed techniques. One embodiment of an expanded area resample function is a cosine function for which is provided an example of an approximate numerical evaluation method. The functions and their evaluation techniques may also be utilized in constructing novel sharpening filters, including a Difference-of-Cosine filter.

28 Claims, 20 Drawing Sheets

1450

| | | | | | | | | |
|---|---|---|---|---|---|---|---|---|
| 0 | 0 | 0 | 0 | 0 | 0 | 0 | 0 | 0 |
| 0 | 0 | 0 | 1 | 7 | 1 | 0 | 0 | 0 |
| 0 | 0 | 3 | 35 | 64 | 35 | 3 | 0 | 0 |
| 0 | 1 | 35 | 125 | 180 | 125 | 35 | 1 | 0 |
| 0 | 7 | 64 | 180 | 244 | 180 | 64 | 7 | 0 |
| 0 | 1 | 35 | 125 | 180 | 125 | 35 | 1 | 0 |
| 0 | 0 | 3 | 35 | 64 | 35 | 3 | 0 | 0 |
| 0 | 0 | 0 | 1 | 7 | 1 | 0 | 0 | 0 |
| 0 | 0 | 0 | 0 | 0 | 0 | 0 | 0 | 0 |

FIG. 14B

SUBPIXEL RENDERING AREA RESAMPLE FUNCTIONS FOR DISPLAY DEVICE

FIELD OF INVENTION

The subject matter of the present application is related to image display devices, and in particular to subpixel rendering techniques for use in rendering image data to a display panel substantially comprising a plurality of a two-dimensional subpixel repeating group.

BACKGROUND

Commonly owned U.S. Pat. No. 7,123,277 entitled "CONVERSION OF A SUB-PIXEL FORMAT DATA TO ANOTHER SUB-PIXEL DATA FORMAT," issued to Elliott et al., discloses a method of converting input image data specified in a first format of primary colors for display on a display panel substantially comprising a plurality of subpixels. The subpixels are arranged in a subpixel repeating group having a second format of primary colors that is different from the first format of the input image data. Note that in U.S. Pat. No. 7,123,277, subpixels are also referred to as "emitters." U.S. Pat. No. 7,123,277 is hereby incorporated by reference herein for all that it teaches.

The term "primary color" refers to each of the colors that occur in the subpixel repeating group. When a subpixel repeating group is repeated across a display panel to form a device with the desired matrix resolution, the display panel is said to substantially comprise the subpixel repeating group. In this discussion, a display panel is described as "substantially" comprising a subpixel repeating group because it is understood that size and/or manufacturing factors or constraints of the display panel may result in panels in which the subpixel repeating group is incomplete at one or more of the panel edges. In addition, any display would "substantially" comprise a given subpixel repeating group when that display had a subpixel repeating group that was within a degree of symmetry, rotation and/or reflection, or any other insubstantial change, of one of the embodiments of a subpixel repeating group illustrated herein or in any one of the issued patents or patent application publications referenced below.

References to display systems or devices using more than three primary subpixel colors to form color images are referred to herein as "multi-primary" display systems. In a display panel having a subpixel repeating group that includes a white (clear) subpixel, such as illustrated in FIGS. 5A and 5B, the white subpixel represents a primary color referred to as white (W) or "clear", and so a display system with a display panel having a subpixel repeating group including RGBW subpixels is a multi-primary display system.

By way of example, the format of the color image data values that indicate an input image may be specified as a two-dimensional array of color values specified as a red (R). green (G) and blue (B) triplet of data values. Thus, each RGB triplet specifies a color at a pixel location in the input image. The display panel of display devices of the type described in U.S. Pat. No. 7,123,277 and in other commonly-owned patent application publications referenced below, substantially comprises a plurality of a subpixel repeating group that specifies a different, or second, format in which the input image data is to be displayed. In one embodiment, the subpixel repeating group is two-dimensional (2D); that is, the subpixel repeating group comprises subpixels in at least first, second and third primary colors that are arranged in at least two rows on the display panel.

For example, display panel 20 of FIG. 2 is substantially comprised of subpixel repeating group 22. In FIG. 2 and in the other Figures that show examples of subpixel repeating groups herein, subpixels shown with vertical hatching are red, subpixels shown with diagonal hatching are green and subpixels 8 shown with horizontal hatching are blue. Subpixels that are white (or clear) are shown with no hatching, such as subpixel 6 in FIG. 5A. In FIG. 21, subpixels 1901 in subpixel repeating groups 1920 and 1923 that have a dashed-line, right-to-left diagonal hatching, indicate an unspecified fourth primary color, which may be magenta, yellow, grey, grayish-blue, pink, greenish-grey, emerald or another suitable primary. Subpixels that have a narrowly spaced horizontal hatching, such as subpixel 1902 in subpixel repeating group 1934, are the color cyan, abbreviated herein as C. Thus, subpixel repeating group 1934 shows a multiprimary RGBC repeating group. With reference again to FIG. 2, in subpixel repeating group 22, the subpixels of two of the primary colors are arranged in what is referred to as a "checkerboard pattern." That is, a second primary color subpixel follows a first primary color in a first row of the subpixel repeating group, and a first primary color subpixel follows a second primary color in a second row of the subpixel repeating group. FIGS. 5A and 5B are also examples of a 2D subpixel repeating group having this checkerboard pattern.

Performing the operation of subpixel rendering the input image data produces a luminance value for each subpixel on the display panel such that the input image specified in the first format is displayed on the display panel comprising the second, different arrangement of primary colored subpixels in a manner that is aesthetically pleasing to a viewer of the image. As noted in U.S. Pat. No. 7,123,277, subpixel rendering operates by using the subpixels as independent pixels perceived by the luminance channel. This allows the subpixels to serve as sampled image reconstruction points as opposed to using the combined subpixels as part of a "true" (or whole) pixel. By using subpixel rendering, the spatial reconstruction of the input image is increased, and the display device is able to independently address, and provide a luminance value for, each subpixel on the display panel.

In addition, in some embodiments of the techniques disclosed in U.S. Pat. No. 7,123,277, the subpixel rendering operation may be implemented in a manner that maintains the color balance among the subpixels on the display panel by ensuring that high spatial frequency information in the luminance component of the image to be rendered does not alias with the color subpixels to introduce color errors. An arrangement of the subpixels in a subpixel repeating group might be suitable for subpixel rendering if subpixel rendering image data upon such an arrangement may provide an increase in both spatial addressability, which may lower phase error, and in the Modulation Transfer Function (MTF) high spatial frequency resolution in both horizontal and vertical axes of the display. In some embodiments of the subpixel rendering operation, the plurality of subpixels for each of the primary colors on the display panel may be collectively defined to be a primary color plane (e.g., red, green and blue color planes) and may be treated individually.

In one embodiment, the subpixel rendering operation may generally proceed as follows. The color image data values of the input image data may be treated as a two-dimensional spatial grid 10 that represents the input image signal data, as shown for example in FIG. 1. Each input image sample area 12 of the grid represents the RGB triplet of color values representing the color at that spatial location or physical area of the image. Each input image sample area 12 of the grid, which may also be referred to as an implied sample area, is further shown with a sample point 14 centered in input image sample area 12.

FIG. 2 illustrates an example of display panel 20 taken from FIG. 6 of U.S. Pat. No. 7,123,277. The display panel comprising the plurality of the subpixel repeating group 22 is assumed to have similar addressable dimensions as the input image sample grid 10 of FIG. 1, considering the use of overlapping logical pixels explained herein. The location of each primary color subpixel on display panel 20 approximates what is referred to as a reconstruction point (or resample point) used by the subpixel rendering operation to reconstruct the input image represented by spatial grid 10 of FIG. 1 on display panel 20 of FIG. 2. Each reconstruction point is centered inside its respective resample area, and so the center of each subpixel may be considered to be the resample point of the subpixel. The set of subpixels on display panel 20 for each primary color is referred to as a primary color plane, and the plurality of resample areas for one of the primary colors comprises a resample area array for that color plane. FIG. 3 (taken from FIG. 9 of U.S. Pat. No. 7,123,277) illustrates an example of resample area array 30 for the blue color plane of display panel 20, showing reconstruction (resample) points 37, roughly square shaped resample areas 38 and resample areas 39 having the shape of a rectangle.

U.S. Pat. No. 7,123,277 describes how the shape of resample area 38 may be determined in one embodiment as follows. Each reconstruction point 37 is positioned at the center of its respective subpixel (e.g., subpixel 8 of FIG. 2), and a grid of boundary lines is formed that is equidistant from the centers of the reconstruction points; the area within each boundary forms a resample area. Thus, in one embodiment, a resample area may be defined as the area closest to its associated reconstruction point, and as having boundaries defined by the set of lines equidistant from other neighboring reconstruction points. The grid that is formed by these lines creates a tiling pattern. Other embodiments of resample area shapes are possible. For example, the shapes that can be utilized in the tiling pattern can include, but are not limited to, squares, rectangles, triangles, hexagons, octagons, diamonds, staggered squares, staggered rectangles, staggered triangles, staggered diamonds, Penrose tiles, rhombuses, distorted rhombuses, and the like, and combinations comprising at least one of the foregoing shapes.

Resample area array 30 is then overlaid on input image sample grid 10 of FIG. 1, as shown in FIG. 4 (taken from FIG. 20 of U.S. Pat. No. 7,123,277.) Each resample area 38 or 39 in FIG. 3 overlays some portion of at least one input image sample area 12 on input image grid 10 (FIG. 1). So, for example, resample area 38 of FIG. 3 overlays input image sample areas 41, 42, 43 and 44. The luminance value for the subpixel represented by resample point 37 is computed using what is referred to as an "area resample function." The luminance value for the subpixel represented by resample point 37 is a function of the ratio of the area of each input image resample area 41, 42, 43 and 44 that is overlapped by resample area 38 to the total area of resample area 38. The area resample function is represented as an image filter, with each filter kernel coefficient representing a multiplier for an input image data value of a respective input image sample area. More generally, these coefficients may also be viewed as a set of fractions for each resample area. In one embodiment, the denominators of the fractions may be construed as being a function of the resample area and the numerators as being the function of an area of each of the input sample areas that at least partially overlaps the resample area. The set of fractions thus collectively represent the image filter, which is typically stored as a matrix of coefficients. In one embodiment, the total of the coefficients is substantially equal to one. The data value for each input sample area is multiplied by its respective fraction and all products are added together to obtain a luminance value for the resample area.

The size of the matrix of coefficients that represent a filter kernel is typically related to the size and shape of the resample area for the reconstruction points and how many input image sample areas the resample area overlaps. In FIG. 4, square shaped resample area 38 overlaps four input sample areas 41, 42, 43 and 44. A 2×2 matrix of coefficients represents the four input image sample areas. It can be seen by simple inspection that each input sample area 41, 42, 43 and 44 contributes one-quarter (¼ or 0.25) of its blue data value to the final luminance value of resample point 37.

This produces what is called a 2×2 box filter for the blue color plane, which can be represented as

| | |
|---|---|
| 0.25 | 0.25 |
| 0.25 | 0.25 |

In this embodiment, the area resample filter for a given primary color subpixel, then, is based on an area resample function that is integrated over the intersection of an incoming pixel area (e.g., implied sample areas 12 of FIG. 1), and normalized by the total area of the area resample function.

In the example illustrated herein, the computations assume that the resample area arrays for the three color planes are coincident with each other and with the input image sample grid 10. That is, the red, green and blue resample area arrays for a panel configured with a given subpixel repeating group are all aligned in the same position with respect to each other and with respect to the input image sample grid of input image data values. For example, in one embodiment, the primary color resample area arrays may all be coincident with each other and aligned at the upper left corner of the input image sample grid. However, it is also possible to align the resample area arrays differently, relative to each other, or relative to the input image sample grid 10. The positioning of the resample area arrays with respect to each other, or with respect to the input image sample grid, is called the phase relationship of the resample area arrays.

Because the subpixel rendering operation renders information to the display panel at the individual subpixel level, the term "logical pixel" is introduced. A logical pixel may have an approximate Gaussian intensity distribution and may overlap other logical pixels to create a full image. Each logical pixel is a collection of nearby subpixels and has a target subpixel, which may be any one of the primary color subpixels, for which an image filter will be used to produce a luminance value. Thus, each subpixel on the display panel is actually used multiple times, once as a center, or target, of a logical pixel, and additional times as the edge or component of another logical pixel. A display panel substantially comprising a subpixel layout of the type disclosed in U.S. Pat. No. 7,123,277 and using the subpixel rendering operation described therein and above achieves nearly equivalent resolution and addressability to that of a convention RGB stripe display but with half the total number of subpixels and half the number of column drivers. Logical pixels are further described in commonly owned U.S. Patent Application Publication No. 2005/0104908 entitled "COLOR DISPLAY PIXEL ARRANGEMENTS AND ADDRESSING MEANS" (U.S. patent application Ser. No. 10/047,995), which is hereby incorporated by reference herein. See also Credelle et al., "MTF of High Resolution PenTile Matrix™ Displays," published in Eurodisplay 02 Digest, 2002, pp 1-4, which is hereby incorporated by reference herein.

Examples of three-primary color and mulit-primary color subpixel repeating groups, including RGBW subpixel repeating groups, and associated subpixel rendering operations are disclosed in the following commonly owned U.S. Patent Application Publications: (1) U.S. Patent Application Publication No. 2004/0051724 (U.S. application Ser. No. 10/243,094), entitled "FOUR COLOR ARRANGEMENTS AND EMITTERS FOR SUB-PIXEL RENDERING;" (2) U.S. Patent Application Publication No. 2003/0128179 (U.S. application Ser. No. 10/278,352), entitled "COLOR FLAT PANEL DISPLAY SUB-PIXEL ARRANGEMENTS AND LAYOUTS FOR SUB-PIXEL RENDERING WITH SPLIT BLUE SUB-PIXELS;" (3) U.S. Patent Application Publication No. 2003/0128225 (U.S. application Ser. No. 10/278,353), entitled "COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE;" (4) U.S. Patent Application Publication No. 2004/0080479 (U.S. application Ser. No. 10/347,001), entitled "SUB-PIXEL ARRANGEMENTS FOR STRIPED DISPLAYS AND METHODS AND SYSTEMS FOR SUB-PIXEL RENDERING SAME;" (5) U.S. Patent Application Publication No. 2005/0225575 (U.S. application Ser. No. 10/961,506), entitled "NOVEL SUBPIXEL LAYOUTS AND ARRANGEMENTS FOR HIGH BRIGHTNESS DISPLAYS;" and (6) U.S. Patent Application Publication No. 2005/0225563 (U.S. application Ser. No. 10/821,388), entitled "SUBPIXEL RENDERING FILTERS FOR HIGH BRIGHTNESS SUBPIXEL LAYOUTS." Each of these aforementioned Patent Application Publications is incorporated herein by reference for all that it teaches.

U.S. 2005/0225575 entitled "NOVEL SUBPIXEL LAYOUTS AND ARRANGEMENTS FOR HIGH BRIGHTNESS DISPLAYS" discloses a plurality of high brightness display panels and devices comprising subpixel repeating groups having at least one white (W) subpixel and a plurality of primary color subpixels. The primary color subpixels may comprise red, blue, green, cyan or magenta in these various embodiments. U.S. 2005/0225563 entitled "SUBPIXEL RENDERING FILTERS FOR HIGH BRIGHTNESS SUBPIXEL LAYOUTS" discloses subpixel rendering techniques for rendering source (input) image data for display on display panels substantially comprising a subpixel repeating group having a white subpixel, including, for example, an RGBW subpixel repeating group. FIGS. 5A and 5B herein, which are reproduced from FIGS. 5A and 5B of U.S. 2005/0225563, illustrate exemplary RGBW subpixel repeating groups 3 and 9 respectively, each of which may be substantially repeated across a display panel to form a high brightness display device. RGBW subpixel repeating group 9 is comprised of eight subpixels disposed in two rows of four columns, and comprises two of red subpixels 2, green subpixels 4, blue subpixels 8 and white (or clear) subpixels 6. If subpixel repeating group 9 is considered to have four quadrants of two subpixels each, then the pair of red and green subpixels are disposed in opposing quadrants, analogous to a "checkerboard" pattern. Other primary colors are also contemplated, including cyan, emerald and magenta. US 2005/0225563 notes that these color names are only "substantially" the colors described as "red", "green", "blue", "cyan", and "white". The exact color points may be adjusted to allow for a desired white point on the display when all of the subpixels are at their brightest state.

US 2005/0225563 discloses that input image data may be processed as follows: (1) Convert conventional RGB input image data (or data having one of the other common formats such as sRGB, YCbCr, or the like) to color data values in a color gamut defined by R, G, B and W, if needed. This conversion may also produce a separate Luminance (L) color plane or color channel. (2) Perform a subpixel rendering operation on each individual color plane. (3) Use the "L" (or "Luminance") plane to sharpen each color plane.

The subpixel rendering operation for rendering input image data that is specified in the RGB triplet format described above onto a display panel comprising an RGBW subpixel repeating group of the type shown in FIGS. 5A and 5B generally follows the area resampling principles disclosed and illustrated in U.S. Pat. No. 7,123,277 and as described above, with some modifications. In the case of a display panel such as display panel 1570 of FIG. 21 substantially comprising RGBCW subpixel repeating group 1934, the reconstruction points for the white subpixels are disposed on a square grid. That is, imaginary grid lines connecting the centers of four nearest neighbor reconstruction points for the narrow white subpixels in repeating group 1934 form a square. US 2005/0225563 discloses that for such a display panel, a unity filter may be used in one embodiment to substantially map the incoming luminance data to the white subpixels. That is, the luminance signal from one incoming conventional image pixel directly maps to the luminance signal of one white subpixel in a subpixel repeating group. In this embodiment of subpixel rendering, the white subpixels reconstruct the bulk of the non-saturated luminance signal of the input image data, and the surrounding primary color subpixels provide the color signal information.

US 2005/0225563 discloses some general information regarding performing the subpixel rendering operation for RGB subpixel repeating groups that have red and green subpixels arranged in opposing quadrants, or on a "checkerboard." The red and green color planes may use a Difference of Gaussian (DOG) Wavelet filter followed by an Area Resample filter. The Area Resample filter removes any spatial frequencies that will cause chromatic aliasing. The DOG wavelet filter is used to sharpen the image using a cross-color component. That is to say, the red color plane is used to sharpen the green subpixel image and the green color plane is used to sharpen the red subpixel image. US 2005/0225563 discloses an exemplary embodiment of these filters as follows:

TABLE 1

| | | | | | | | | | | | |
|---|---|---|---|---|---|---|---|---|---|---|---|
| −0.0625 | 0 | −0.0625 | | 0 | 0.125 | 0 | | −0.0625 | 0.125 | −0.0625 |
| 0 | 0.25 | 0 | + | 0.125 | 0.5 | 0.125 | = | 0.125 | 0.75 | 0.125 |
| −0.0625 | 0 | −0.0625 | | 0 | 0.125 | 0 | | −0.0625 | 0.125 | −0.0625 |
| DOG Wavelet Filter | | | + | Area Resample Filter | | | | Cross-Color Sharpening Kernel | | |

The blue color plane may be resampled using one of a plurality of filters, such as the 2×2 box filter shown below:

| | |
|---|---|
| 0.25 | 0.25 |
| 0.25 | 0.25. |

In the case of subpixel repeating group 1926 of FIG. 21, the blue subpixels 1903 are configured to have a narrow aspect ratio such that the combined area of two blue subpixels equals the area of one of the red or green subpixels. For that reason, these blue subpixels are sometimes referred to as "split blue subpixels," as described in commonly-owned and copending patent application US 2003/0128179 referenced above. The blue color plane for subpixel repeating group 1926 may be resampled using the box-tent filter of (0.125, 0.25, 0.125) centered on one of the split blue subpixels.

In one embodiment for producing the color signal information in the primary color subpixels, the image date of each input pixel is mapped to two sub-pixels on the display panel. In effecting this, there are still a number of different ways to align the input image sample areas with the primary color subpixels in order to generate the area resample filters. FIG. 6 (taken from FIG. 6 of US 2005/0225563) illustrates an area resample mapping of four input image sample areas 12 to the eight subpixels of subpixel repeating group 3 shown in FIG. 5A. Input image data is again depicted as shown in FIG. 1, as an array, or grid, 10 of squares, with each square 12 representing the color data values of an input image pixel, i.e., typically an RGB triplet. FIG. 6 illustrates a portion of a resample area array for the red color plane. Subpixel repeating group 3 of FIG. 5A, shown in the dark outline in FIG. 6, is superimposed upon grid 10 in an example of an alignment in which two subpixels are substantially aligned with the color image data of one input image pixel sample area 12 on grid 10. Note that in other embodiments, one subpixel may overlay the area of several input image sample areas 12. Black dots 65 in FIG. 6 represent the centers of the red subpixels of subpixel repeating group 3 (designated as red supixel 2 in FIG. 5A). The resample area array for the red color plane comprises red resample areas such as resample areas 64 and 66 that have a diamond shape, with the center of each resample area being aligned with the center 65 of a red subpixel. It can be seen that the resample areas 64 and 66 each overlay a portion of several input image sample areas. Computing the filter coefficients for the area resample filter produces what is referred to as a "diamond" filter, an example of which is the Area Resample Filter illustrated in Table 1 above.

FIG. 7 illustrates a red resample area array 260 for a display panel configured with either subpixel repeating group 3 (FIG. 5A) or 9 (FIG. 5B), and with resample areas 64 and 66 of FIG. 6 called out. Thus, when one reproduces subpixel repeating group 3 across a larger portion of grid 10 than is shown in FIG. 6, the result is resample area array 260 of FIG. 7 for the red subpixel color plane. Note that resample area arrays for green subpixels 4, blue subpixels 8 and white subpixels 6 each may be separately considered to have a similar diagonal layout.

Other subpixel repeating groups may also give rise to primary color resample area arrays having a similar diamond shape configuration. See, for example, multi-primary six-subpixel repeating group 1936 of FIG. 21 configured as

| | | |
|---|---|---|
| R | B | G |
| G | W | R |

where R, G, B and W represent red, green, blue and white subpixels, respectively. In this example, the red resample area array with reconstruction points at the centers of the red subpixels defines one diagonal arrangement of resample points and the green resample area array with reconstruction points at the centers of the green subpixels defines a similar but out-of-phase diagonal arrangement.

Note that FIG. 6 illustrates a specific alignment of subpixel repeating group 3 with input image sample grid 10 and resample area array 260 of the red color plane. US 2005/0225563 discloses that any one or more aspects of the alignment of the input image pixel grid with the subpixel repeating group, or with the resample areas for each color plane, the choice of the location of the resample points vis-à-vis the input image sample grid, and the shapes of the resample areas, may be modified. In some embodiments, such modifications may simplify the area resample filters that are produced. Several examples of such modifications are disclosed therein.

Commonly owned International Application PCT/US06/19657 entitled MULTIPRIMARY COLOR SUBPIXEL RENDERING WITH METAMERIC FILTERING discloses systems and methods of rendering input image data to multiprimary displays that utilize metamers to adjust the output color data values of the subpixels. International Application PCT/US06/19657 is published as WO International Patent Publication No. 2006/127555, which is hereby incorporated by reference herein. In a multiprimary display in which the subpixels have four or more non-coincident color primaries, there are often multiple combinations of values for the primaries that may give the same color value. That is to say, for a color with a given hue, saturation, and brightness, there may be more than one set of intensity values of the four or more primaries that may give the same color impression to a human viewer. Each such possible intensity value set is called a "metamer" for that color. Thus, a metamer on a display substantially comprising a particular multiprimary subpixel repeating group is a combination (or a set) of at least two groups of colored subpixels such that there exists signals that, when applied to each such group, yields a desired color that is perceived by the Human Vision System. Using metamers provides a degree of freedom for adjusting relative values of the colored primaries to achieve desired goal, such as improving image rendering accuracy or perception. The metamer filtering operation may be based upon input image content and may optimize subpixel data values according to many possible desired effects, thus improving the overall results of the subpixel rendering operation. The metamer filtering operation is discussed in conjunction with sharpening filters in more detail below. The reader is also referred to WO 2006/127555 for further information.

The model of exemplary subpixel rendering operations based on area resample principles that is disclosed in U.S. Pat. No. 7,123,277 and in US 2005/0225563 places a reconstruction point (or resample point) that is used by the subpixel rendering operation to reconstruct the input image in the center of its respective resample area as representing a particular subpixel's "optical-center-of-gravity." In the discussion of exemplary subpixel rendering operations disclosed in U.S. Pat. No. 7,123,277 and in US 2005/0225563, a resample area is defined as the area closest to a given subpixel's reconstruction point (i.e., within the resample area) but not closer to any other reconstruction point in the resample area array for that primary color. This can be seen in FIG. 6 where the boundary between resample areas 64 and 66 is equidistant between the two reconstruction points 65. The extent of the area resample function is confined to the area inside the defined resample area.

SUMMARY

Input image data indicating an image is rendered to a display panel in a display device or system that is substantially configured with a three primary color or multi-primary color subpixel repeating group using a subpixel rendering operation based on area resampling techniques. Examples of expanded area resample functions have properties that maintain color balance in the output image and, in some embodiments, are evaluated using an increased number of input image sample points farther away in distance from the subpixel being reconstructed. One embodiment of an expanded area resample function is a cosine function for which is provided an example of an approximate numerical evaluation method. The functions and their evaluation techniques may also be utilized in constructing sharpening filters.

A display system comprises a source image receiving unit configured for receiving source image data indicating an input image. Each color data value in the source image data indicates an input image sample point. The display system also comprises a display panel substantially comprising a plurality of a subpixel repeating group comprising at least two rows of primary color subpixels, Each primary color subpixel represents an image reconstruction point for use in computing a luminance value for an output image. The display system also comprises subpixel rendering circuitry configured for computing a luminance value for each image reconstruction point using the source image data and an area resample function centered on a target image reconstruction point. The luminance values computed for each image reconstruction point collectively indicate the output image. At least one of values v1 and v2 respectively computed using the area resample function centered on a first target image reconstruction point and the area resample function centered on a second target image reconstruction point at a common input image sample point between said first and second target image reconstruction points is a non-zero value. The display system further comprises driver circuitry configured to send signals to said subpixels on said display panel to render said output image.

BRIEF DESCRIPTION OF THE DRAWINGS

The accompanying drawings are incorporated in, and constitute a part of this specification, and illustrate exemplary implementations and embodiments.

FIG. 14B is an exemplary area resample filter kernel produced by the operation depicted in the flowchart of FIG. 14A, after a normalizing operation has been performed on the filter kernel coefficients.

DETAILED DESCRIPTION

Reference will now be made in detail to implementations and embodiments, examples of which are illustrated in the accompanying drawings. Wherever possible, the same reference numbers will be used throughout the drawings to refer to the same or like parts.

A Bi-Valued Area Resample Function

Figure 5A:
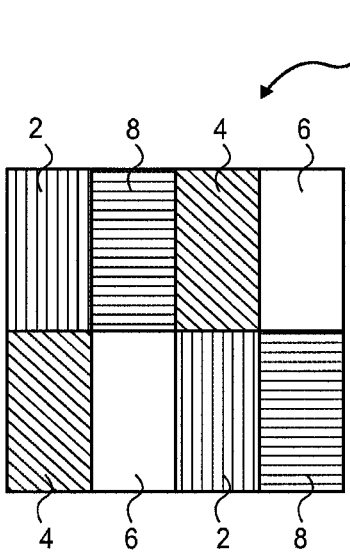
FIGS. 5A and 5B each illustrate a subpixel repeating group comprising two rows of four subpixels in three primary colors and white.
Figure 5B:
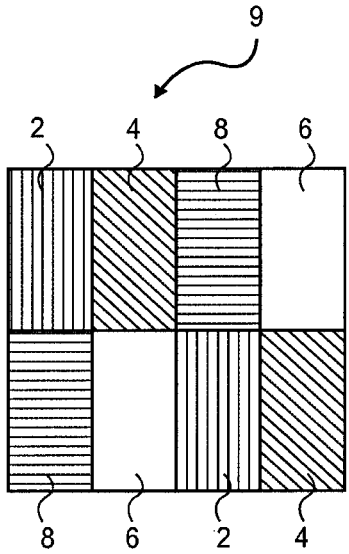

In contrast to area resampling techniques described in the earlier referenced publications, for a given target resample point, or reconstruction point, an area resample function may evaluate input image sample points that extend to the next adjacent resample point. In this frame of reference, the area resample function is defined to be a bi-valued function that evaluates input image data for implied sample areas that extend all the way to the nearest neighboring reconstruction points. By way of example, consider red resample area array 260 of FIG. 7, which represents the red color plane of a display panel configured with one of subpixel repeating groups 3 and 9 of FIGS. 5A and 5B, and includes a plurality of diamond-shaped red resample areas 210 each having a reconstruction point 205. Consider also a centrally located resample area 200 having resample point 101. FIG. 8A graphically represents a one dimensional cross-section of bi-valued area resample function 100 for resample area 200 with resample point 105, along dashed-and-dotted line 250 in FIG. 7, extending to resample points 105 on either side of resample point 101.

With continued reference to FIG. 8A, resample function 100 may be viewed as extending to each of the nearest neighboring reconstruction points 105 of the same color. Dot-and-dashed lines 127 half-way between the central reconstruction point 101 and neighboring reconstruction points 105 indicates the boundary of resample area 200 of FIG. 7, but area resample function 100 may be viewed as extending to reconstruction points 105. From this frame of reference, it can be seen from the graph that resample function 100 is bi-valued, having a high value 110 at reconstruction point 101 and to both extents of resample area 200 (as bounded by dot-and-dashed lines 127), which is halfway to neighboring reconstruction points 105. Beyond the extent of resample area 200, indicated by graph portions 120, resample function 100 is zero-valued out to neighboring reconstruction points 105.

Figure 7:
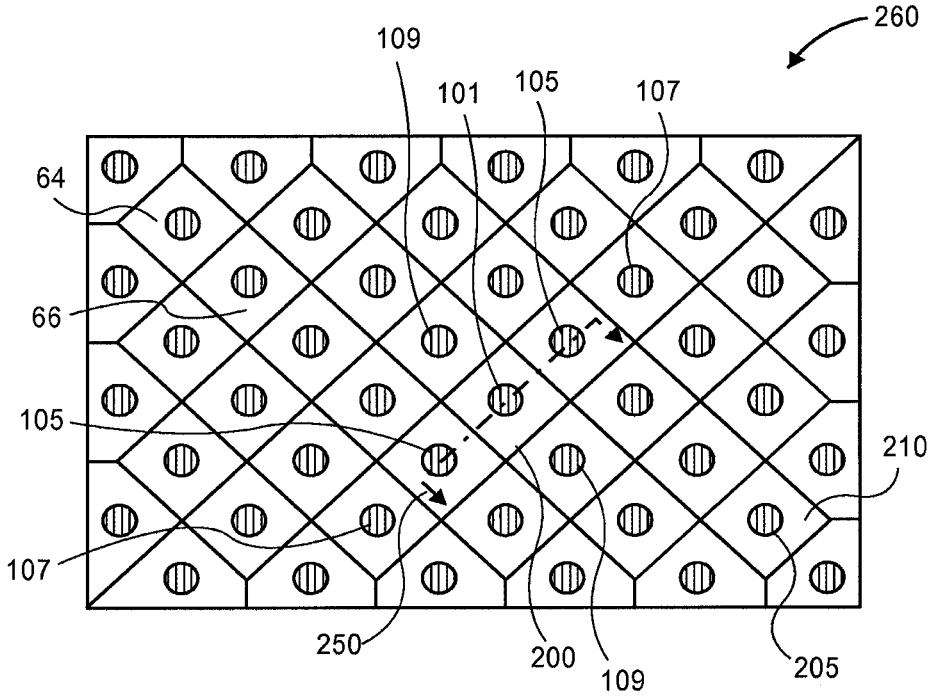
FIG. 7 illustrates a resample area array for the red subpixels of a display panel configured with the subpixel repeating group of either FIG. 5A or 5B.
Figure 8A:
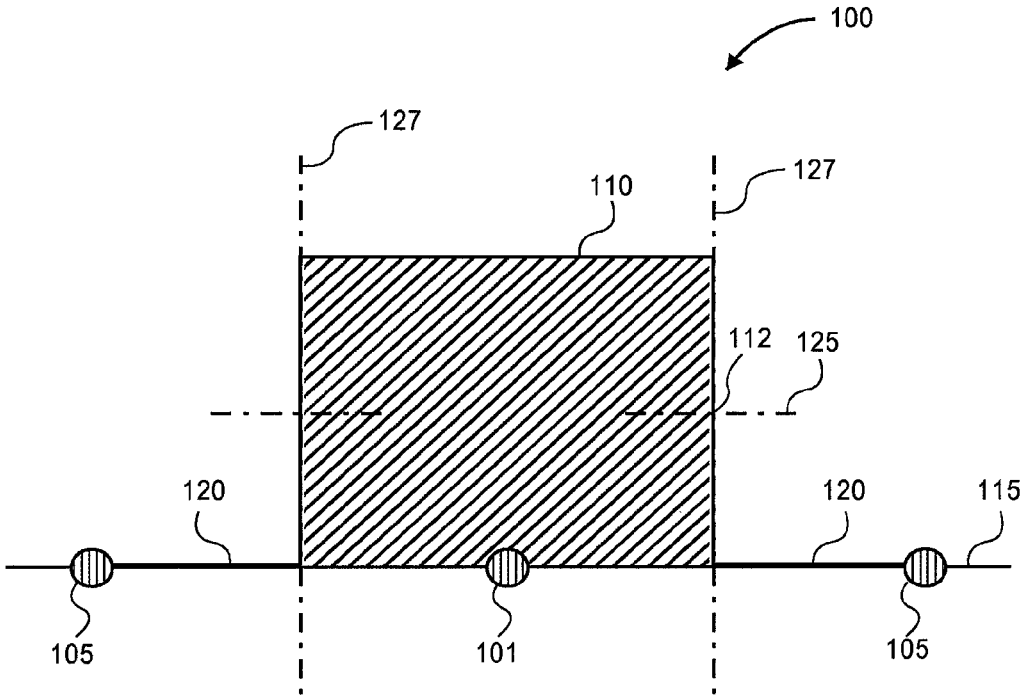
FIG. 8A graphically illustrates a bi-valued area resample function for computing the luminance value at an exemplary resample point at a cross-section of the resample area array of FIG. 7.
Figure 8B:
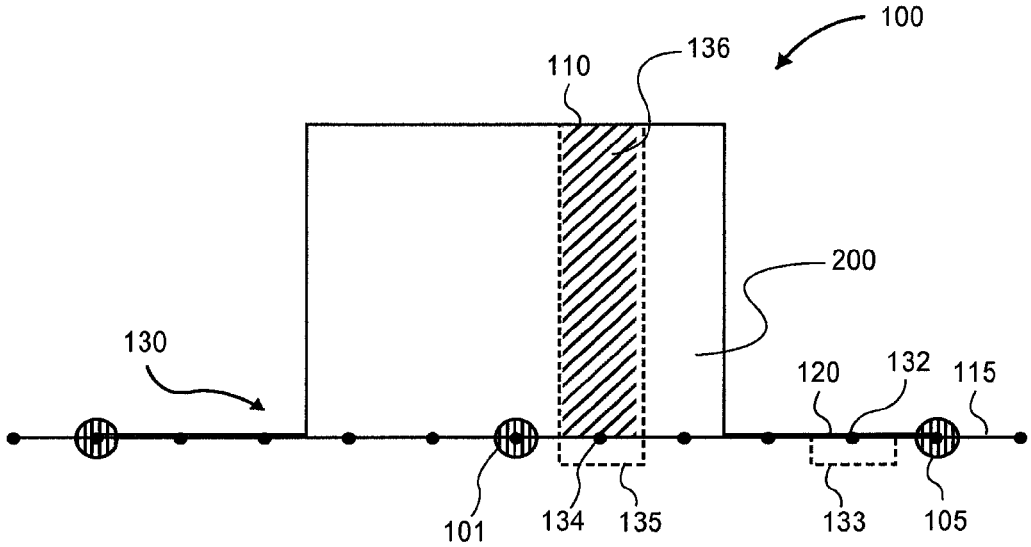
FIGS. 8B and 8C graphically illustrate examples of the resample integration computation using the bi-valued area resample function of FIG. 8A for selected ones of the input image data samples for an exemplary resample point.

FIG. 8B graphically illustrates area resample function 100 of FIG. 8A with a set 130 of input image sample points represented by the black dots along baseline 115. In effect, this graphically represents red resample area array 260 of FIG. 7 overlaid on input image sample grid 10 of FIG. 1, at the portion of resample area array 260 shown at dashed-and-dotted line 250 of FIG. 7. The implied sample area 12 (FIG. 1) of each input image sample point is represented by a vertical rectangular area 135 bounded by dashed lines around an input image sample point 134. Note that in this example that there are more input image sample points 130 than reconstruction points 105 and 101.

In FIG. 8B, it can be seen that input image sample point 134 and its associated implied sample area 135 is completely within the high valued portion 110 of the resample function 100. As described above, the area overlap ratio between the implied sample area 135 and the resample area 200 is used to define a value in the area resample filter kernel. However, in this example, the value of the resample function 100 is also used to weight the value in the area resample filter kernel. The resample function value 110 is integrated over the area of implied sample area 135, as illustrated by diagonal hatching 136. Since implied sample area 135 is completely inside of resample area 200, function 100 has a constant value of one (1). In contrast, the resample function value over implied sample area 133 associated with the input image sample point 132 located outside of resample area 200 is zero (0) at portion 120 of function 100, and thus the value in the area resample filter kernel is zero (0).

Figure 8C:
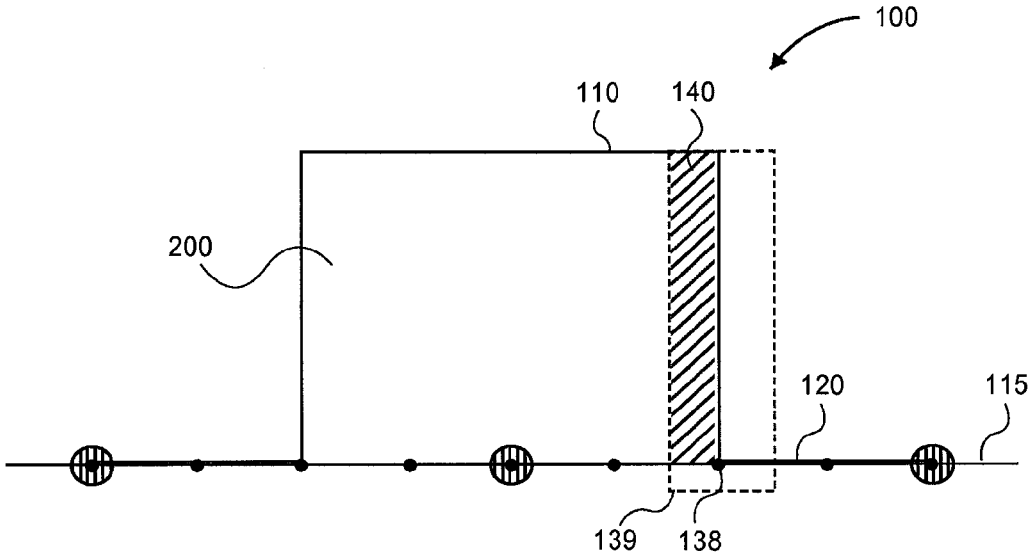

In FIG. 8C, input image sample point 138 is at the boundary of resample area 200 such that it's associated implied sample area 139 is half in and half out of resample area 200. When resample function 100 is integrated over the portion of implied sample area 139 within resample area 200, as illustrated in the figure by diagonal hatching 140, a weighted value is defined for the area resample filter kernel that is the value found for the portion of input image sample point 139 inside of the resample area. That is, the integration is half of the total area 139, and so is the sum of half of the peak value 110 of area resample function 100 (i.e., the constant one (1)) and half of the low value zero (0) at portion 120 of area resample function 100. In this frame of reference, area resample function 100 as illustrated in FIGS. 8A, 8B and 8C evaluates all input image sample points that lie between reconstruction point 101 and neighboring reconstruction points 105, according to the specified function. Because function 100 is bi-valued, luminance values of input image sample points outside the resample area 200 of reconstruction point 101 do not contribute to the luminance value of the subpixel reconstructed by reconstruction point 101.

Exemplary. bi-valued area resample function 100, as illustrated in FIGS. 8A, 8B and 8C, is only one of possible other area resample functions that implement the principles of area resampling in a manner that may ultimately lead to improvements in the aesthetic quality of the image that is rendered on the display panel. That is, some area resample functions may use luminance contributions from input image sample points that are farther away from the subpixel being reconstructed than is disclosed in the earlier work described above.

A proposed new area resample function may be evaluated according to whether it produces acceptable subpixel rendering performance. In many applications, one condition of acceptable subpixel rendering performance is that the color balance of the input image pixels is maintained in the image that is rendered on the display panel substantially comprising one of the subpixel repeating group arrangements in the aforementioned patent application publications or issued patents. Maintaining color balance may be implemented as a constraint imposed on a proposed new area resample function. For example, one such implementation may be to constrain the area resample function to have one or more of the following four properties:

(1) The area resample function has a maximum value at the target reconstruction point at the center of the function.

(2) The area resample function has the property that, for a common input data point between a target reconstruction point and the next nearest neighboring reconstruction point, the value of the function that is centered on the target reconstruction point and the value of the overlapping function that is centered on the next nearest neighboring reconstruction point sum to a non-zero constant. In one embodiment, the constant is one (1). A corollary to this is that the function passes through half the maximum value when halfway to the center of the two nearest neighboring reconstruction points when only two functions overlap.

(3) The area resample function is zero at the centers of, and the lines between, the nearest (and possibly next nearest) neighboring reconstruction points and remains zero outside the nearest (and possibly next nearest) neighboring reconstruction points to keep the filter kernal support as small as possible.

(4) The sum (integral) under the resample function is one (1), or some fixed point binary representation of one (1), for each reconstruction point of a given color.

Multi-Valued Linearly Decreasing Area Resample Functions

Figure 9A:
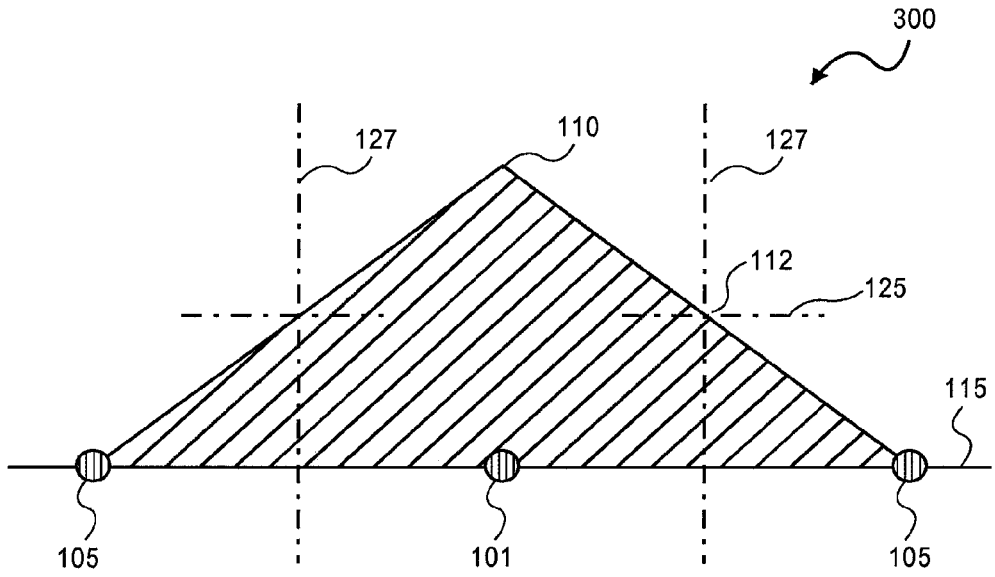
FIG. 9A shows a cross section of a first embodiment of a linearly decreasing area resample function for computing the luminance value at an exemplary resample point at a cross-section of the resample area array of FIG. 7.

FIG. 9A graphically illustrates area resample linearly decreasing valued function 300. Function 300 has a maximum value 110 of one (1) at the given reconstruction point 101 and zero (0) at the neighboring reconstruction points 105 of the same color. As in FIG. 8A, vertical dashed lines 127 represent the extent of resample area 200 of reconstruction point 101 in FIG. 7. Area resample function 300 passes through the half way value 125 of maximum value 110 as it passes the equidistant point 127 between neighboring reconstruction points 105 of a given color plane. That is to say, area resample function 300 has an instantaneous value of one-half (0.5) as it passes through mid point 112. In addition, the integral of the total area of area resample function 300, which is the hatched area under the triangle shape of function 300, is valued at one (1) so that the sum of the overlap areas sum to one. These two characteristics of area resample function 300 make it a candidate to meet the condition of maintaining color balance in the output image.

Figure 9B:
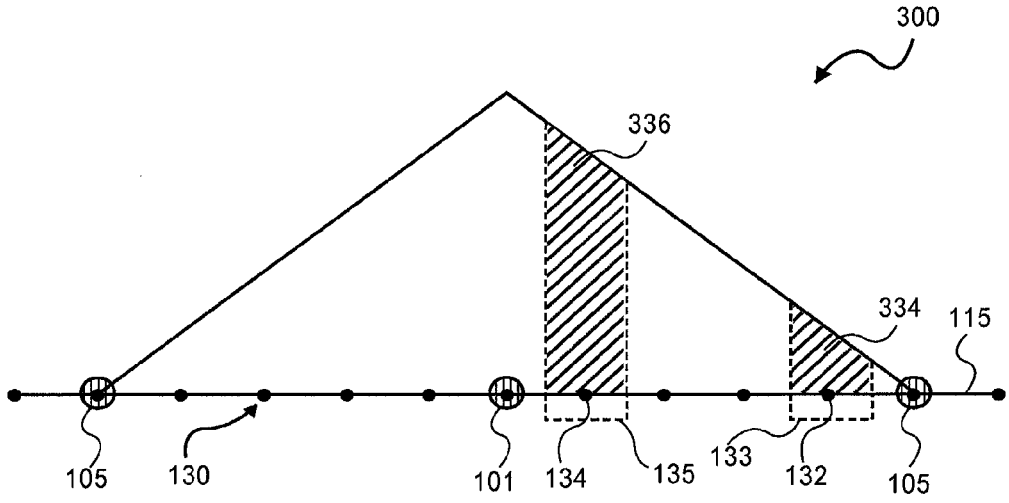
FIG. 9B graphically illustrates examples of the resample integration computation using the linearly decreasing area resample function of FIG. 9A for selected ones of the input image data samples for an exemplary resample point.

FIG. 9B graphically illustrates area resample linearly decreasing valued function 300 of FIG. 9A with a set of input image sample points 130, represented by the black dots along baseline 115, mapped onto the reconstruction points 105 and 101. Again, in this example there are more input image sample points 130 than reconstruction points 105 and 101. Each input image sample point 130 has an associated implied sample area. By way of example, consider input image sample points 134 and 132. Input image sample point 134 and its associated implied sample area 135 is closer to reconstruction point 101 than input image sample point 132 and its associated implied sample area 133, and is in the high valued portion of area resample function 300. The integration of the area resample function 300 over the implied sample area 135, as indicated in the figure by hatching area 336, is used to define a value in the weighted area resample filter kernel for the reconstruction point 101. In contrast, the integration of area resample function 300 over implied sample area 133 associated with input image sample point 132, as illustrated by hatching 334, produces a lower value for the function because input image sample point 132 is closer to the neighboring reconstruction point 105.

Area resample function 300 has the property of weighting the central input image sample points (e.g. sample point 134) greater than those input image sample points that are further away (e.g. sample point 132) from reconstruction point 101. Recall that, in area resample function 100 as illustrated in FIG. 8A, only the luminance values of input image sample points overlaid by the resample area 200 of reconstruction point 101 contribute to the luminance value of the subpixel reconstructed by reconstruction point 101. When using area resample function 100, input image sample point 132 would produce a value of zero and would not contribute to the value of the subpixel being reconstructed by resample point 101. In contrast, area resample function 300 as illustrated in FIG. 9A uses the luminance values of substantially all input image sample points between reconstruction point 101 and neighboring reconstruction points 105 in order to produce the luminance value of the subpixel reconstructed by reconstruction point 101.

Figure 10:
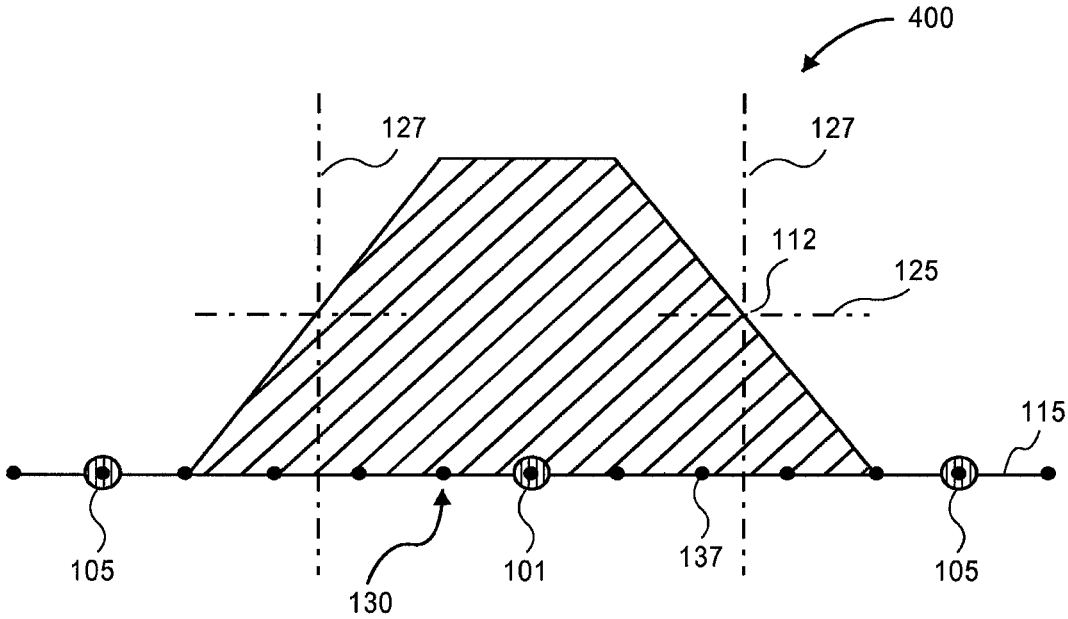
FIG. 10 graphically illustrates a cross section of a second embodiment of a linearly decreasing area resample function for computing the luminance value at an exemplary resample point at a cross-section of the resample area array of FIG. 7.

FIG. 10 graphically illustrates a second example of an area resample linearly decreasing valued function 400 that has a maximum of one (1) at the given reconstruction point 101 and zero (0) at the neighboring reconstruction points 105 in the same primary color plane. Area resample function 400 has the property that the integral of the implied sample area mapped to the central reconstruction point 101 is maximized and the integral of the implied sample areas mapped to the nearby neighboring reconstruction points 105 are minimized at zero (0). Area resample function 400 may be viewed as a type of a hybrid function between bi-valued area resample function 100 illustrated in FIG. 8A and area resample function 300 illustrated in FIG. 9A. Area resample function 400 is similar to area resample function 300 in that function 400 also meets the requirement of having an instantaneous value of one-half (0.5) as it passes through mid point 112, which is at the edge of resample area 200 (FIG. 7) at position 127, half way between two reconstruction points 101 and 105. Consider the respective shapes of the two graphs for functions 300 and 400. In contrast to function 300, it can be seen that function 400 uses the luminance values of fewer than all input image sample points 130 between reconstruction point 101 and neighboring reconstruction points 105 in order to produce the luminance value of the subpixel reconstructed by reconstruction point 101.

Multi-Valued Cosine Area Resample Functions

Figure 11A:
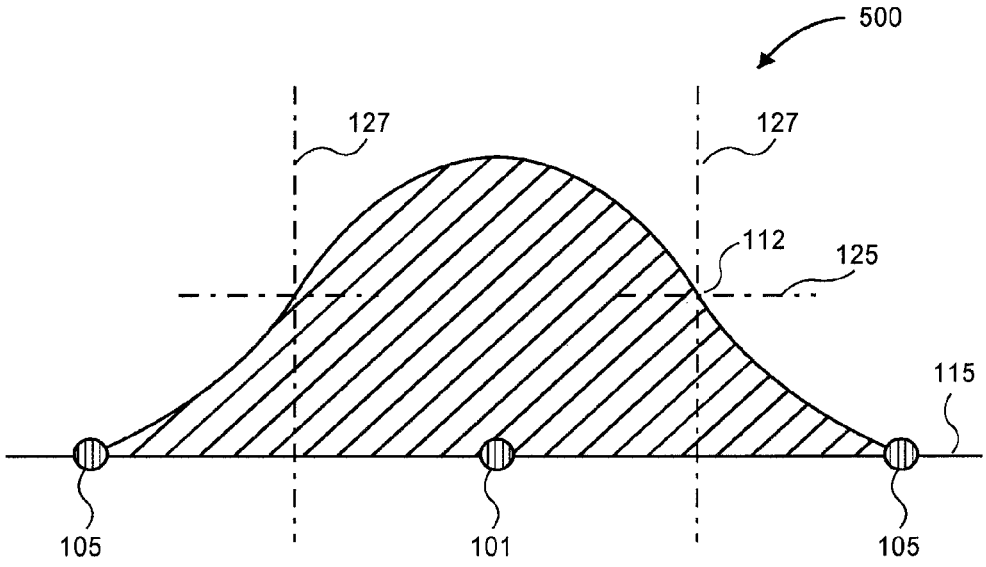
FIG. 11A graphically illustrates a cross section of a first embodiment of an area resample function based on the cosine function for computing the luminance value at an exemplary resample point at a cross-section of the resample area array of FIG. 7.

FIG. 11A graphically illustrates cosine function f1(x), defined below in Equation (1), as area resample function 500. Area resample function 500 starts at zero at leftmost near neighbor reconstruction point 105, climbing to one (1) when centered on reconstruction point 101 and falling to zero again at rightmost near neighbor reconstruction point 105 in the primary color plane. This cosine function may be expressed as $$f1(x)=(\cos(x)+1)/2. \qquad \text{Equation (1)}$$

where f1(x) is evaluated from x=−180° to +180°. As in FIG. 8A, vertical dashed lines 127 in FIG. 11A represent the extent of resample area 200 in FIG. 11A. A cosine function may be a useful area resample function in that it directly captures the positional phase of the position of an input image sample point with respect to the positions of the reconstruction points.

Figure 11B:
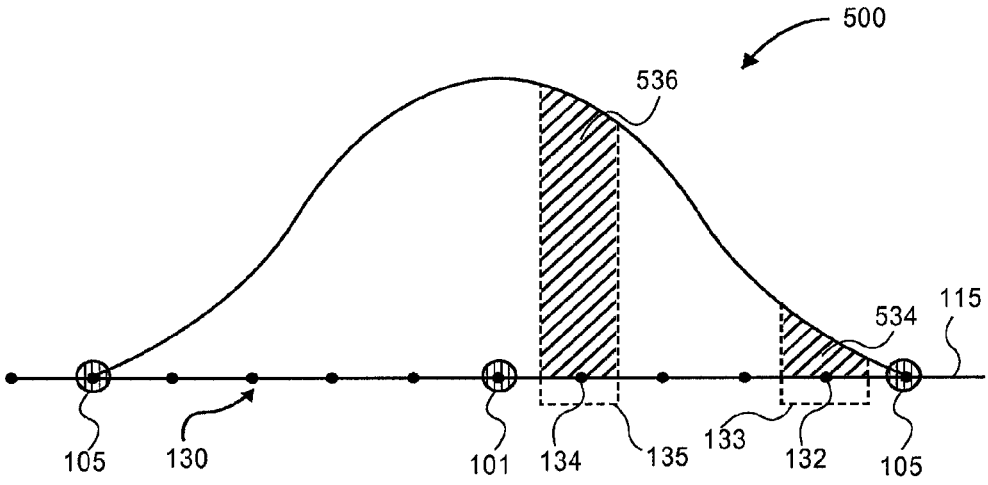
FIG. 11B graphically illustrates examples of the resample integration computation using the area resample cosine function of FIG. 11A for selected ones of the input image data samples for an exemplary resample point.

FIG. 11B graphically illustrates area resample cosine function 500 of FIG. 11A with a set of input image sample points 130, represented by the black dots along baseline 115, mapped onto the reconstruction points 105 and 101. Again, in this example there are more input image sample points 130 than reconstruction points 105 and 101. Each input image sample point 130 has an associated implied sample area. As in the example discussed in FIG. 9B, FIG. 11B also graphically illustrates the treatment of input image sample points 134 and 132. Input image sample point 134 and its associated implied sample area 135 is closer to reconstruction point 101 than input image sample point 132 and its associated implied sample area 133, and is in the high valued portion of area resample function 500. The integration of the area resample function 500 over the implied sample area 135, as indicated in the figure by hatching area 536, is used to define a value in the weighted area resample filter kernel for the reconstruction point 101. In contrast, the integration of area resample function 500 over implied sample area 133 associated with input image sample point 132, as illustrated by hatching 534, produces a lower value for the function because input image sample point 132 is closer to the neighboring reconstruction point 105. Thus, area resample function 500 also has the property of weighting the central input image sample points 130 (e.g. sample point 134) greater than input image sample points 130 that are further away (e.g. sample point 132) from reconstruction point 101.

Inspecting the graph of area resample cosine function 500 in FIG. 11B, it can be seen that function 500 has expanded beyond resample area 200 denoted by vertical dashed lines 127. Function 500 uses the luminance values of substantially all input image sample points between reconstruction point 101 and neighboring reconstruction points 105 in order to produce the luminance value of the subpixel reconstructed by reconstruction point 101.

Overlapping Property of Area Resample Functions

Figure 18A:
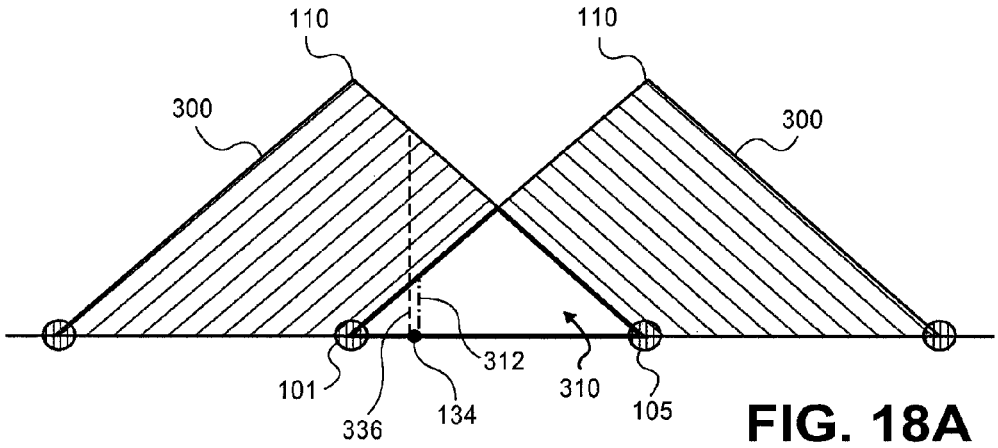
FIGS. 18A, 18B and 18C graphically illustrate the overlapping property of the area resample functions described in FIGS. 9A, 10 and 11A respectively.
Figure 18B:
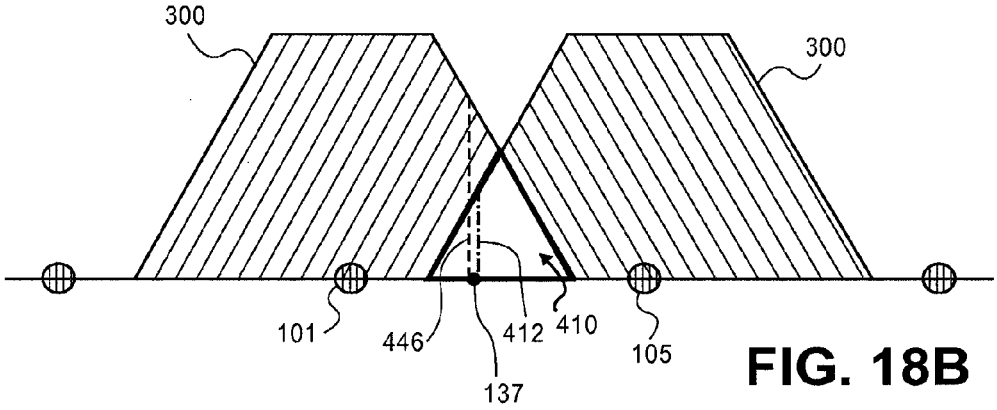
Figure 18C:
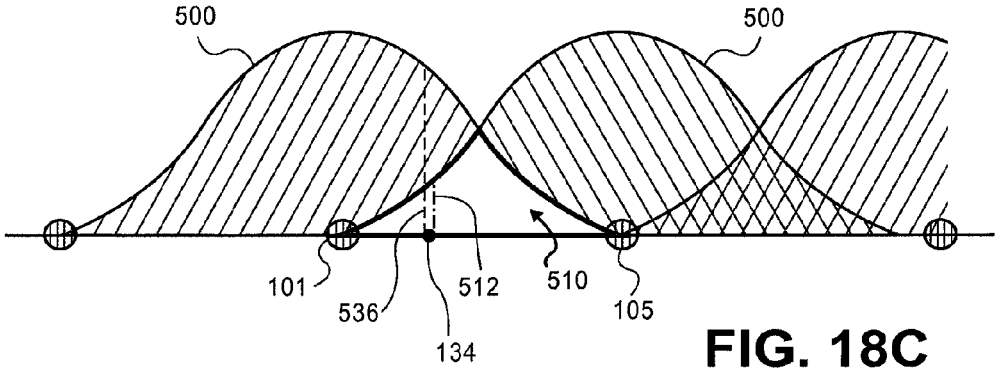

FIGS. 18A, 18B and 18C illustrate what is referred to in an abbreviated manner as the "overlapping" property of the novel area resample functions described in FIGS. 9A, 10 and 11A. To restate from above, in order to preserve color balance in an output image, it may be desirable for the area resample function to have the property that, for a common input image sample point between a target reconstruction point and the next nearest neighboring reconstruction point, the value of the area resample function centered on a first reconstruction point at the common input image sample point and the value of the overlapping function centered on the next nearest neighboring reconstruction point at the common input image sample point sum to a constant.

FIG. 18A illustrates area resample function 300 of FIG. 9A centered on reconstruction points 101 and 105. Functions 300 each have a maximum value 110 at their respective target reconstruction points and the functions overlap in overlapping area 310. Input image sample points that fall within overlapping area 310 illustrate the "overlapping" property of area resample function 300.

More specifically, input image sample point 134 is a common input image sample point that is used for evaluating function 300 for both reconstruction points 101 and 105. As noted above in the discussion of FIG. 9B, input image sample point 134 has an associated implied sample area 135 (see FIG. 9B) that is in the high valued portion of area resample function 300 for reconstruction point 101. It can also be observed from FIG. 18A that implied sample area 135 for input image sample point 134 is in the low valued portion of area resample function 300 for reconstruction point 105. In FIG. 9B it was shown that the integration of area resample function 300 over the implied sample area 135, as indicated in the figure by hatching area 336, is used to define a value in the weighted area resample filter kernel for the reconstruction point 101. In FIG. 18A, hatching area 336 is represented by dashed line 336 at input image sample point 134. Dashed-and-dotted line 312 represents the integration of area resample function 300 for reconstruction point 105 over the implied sample area for input image sample point 134. Note that lines 336 and 312 are shown separated in the Figure for purposes of illustration, but it is understood that each line represents the integration of area resample function 300 for a respective reconstruction point 101 and 105 over the implied sample area 135 for the same input image sample point 134. Lines 336 and 312 illustrate the property that, for the common input image sample point 134, the value of area resample function 300 centered on reconstruction point 101 and the value of overlapping area resample function centered on the next nearest neighboring reconstruction point 105 sum to a constant.

FIGS. 18B and 18C illustrate this same property for the area resample functions graphically illustrated in FIGS. 10 and 11A, using reference numbers in common with those figures. With reference to FIG. 18B, input image sample point 137 is a common input image sample point that is used for evaluating function 400 of FIG. 10 for both reconstruction points 101 and 105. Dashed line 446 at input image sample point 137 represents the integration of area resample function 400 over the implied sample area for sample point 137 to produce a value in the weighted area resample filter kernel for the reconstruction point 101. Dashed-and-dotted line 412 represents the integration of area resample function 400 for reconstruction point 105 over the implied sample area for input image sample point 137. Again note that lines 436 and 412 are shown separated in the Figure for purposes of illustration, but it is understood that each line represents the integration of area resample function 400 for a respective reconstruction point 101 and 105 over the implied sample area for the same input image sample point 137. Lines 436 and 412 illustrate the property that, for the common input image sample point 137, the value of area resample function 400 centered on reconstruction point 101 and the value of overlapping area resample function 400 centered on the next nearest neighboring reconstruction point 105 sum to a constant.

With reference to FIG. 18C, input image sample point 134 is a common input image sample point that is used for evaluating function 500 of FIG. 11A for both reconstruction points 101 and 105. Dashed line 536 at input image sample point 134 represents the integration of area resample function 500 over the implied sample area 135 (FIG. 11B) for sample point 134 to produce a value in the weighted area resample filter kernel for the reconstruction point 101. Dashed-and-dotted line 512 represents the integration of area resample function 500 for reconstruction point 105 over the implied sample area 135 (FIG. 11B) for input image sample point 134. Again note that lines 536 and 512 are shown separated in the Figure for purposes of illustration, but it is understood that each line represents the integration of area resample function 500 for a respective reconstruction point 101 and 105 over the implied sample area 135 for the same input image sample point 134. Lines 536 and 512 illustrate the property that, for the common input image sample point 134, the value of area resample function 500 centered on reconstruction point 101 and the value of overlapping area resample function 500 centered on the next nearest neighboring reconstruction point 105 sum to a constant.

Two-Dimensional Area Resample Functions

FIGS. 8A, 9A, 10 and 11A graphically illustrate area resample functions as viewed from a one-dimensional (1D) cross section of resample area array 260 of FIG. 7 (i.e., as denoted at line 250 in FIG. 7). These figures illustrate the extent of an area resample function from an exemplary resample (reconstruction) point 101 to neighboring reconstruction points 105, as measured by a distance in one dimension along diagonal dashed line 250 in FIG. 7. Recall that bi-value area resample function 100 of FIG. 8A produces non-zero values only for input image sample points overlaid by resample area 200 shown in FIG. 7, while the area resample functions illustrated in FIGS. 9A, 10 and 11A produce non-zero values for input image sample points that extend beyond resample area 200.

In effect, for a given reconstruction point, the area resample functions illustrated in FIGS. 9A, 10 and 11A evaluate input image data in implied sample areas that lay outside the confines of the resample area as defined in the prior published references.

Figure 6:
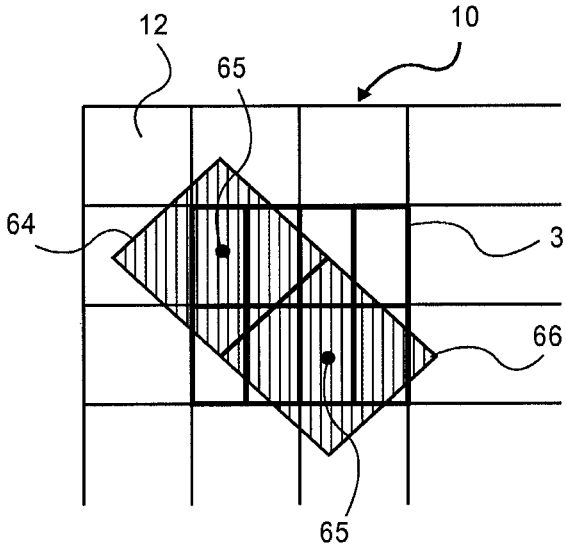
FIG. 6 illustrates the subpixel repeating group of FIG. 5A positioned on the two-dimensional spatial grid of FIG. 1, and further showing a portion of a primary color resample area array for the subpixel repeating group of FIG. 5A superimposed thereon.

The one-dimensional (1D) cross sectional view of an area resample function, however, does not represent all of the input image sample points that need to be evaluated to produce a luminance value for a given resample point. It can be seen from examining FIG. 6 that a single implied sample area 12 in the input image may contribute to the luminance value of as many as four resample points in a single primary color plane array, and that these implied sample areas lay in two dimensions with respect to a resample point.

Figure 1:
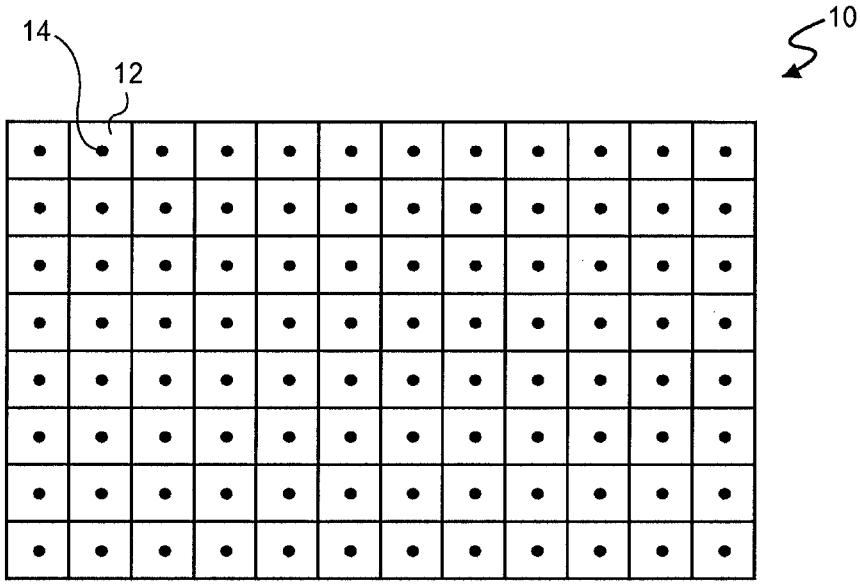
FIG. 1 illustrates a two-dimensional spatial grid representative of input image signal data.
Figure 2:
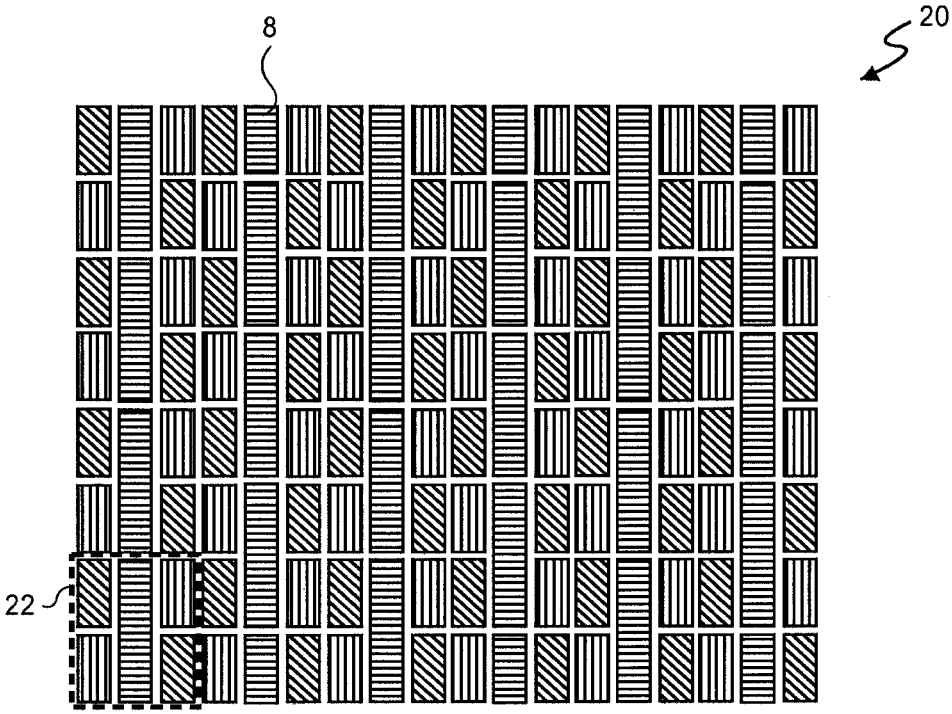
FIG. 2 illustrates a matrix arrangement of a plurality of a subpixel repeating group comprising subpixels in three primary colors that is suitable for a display panel.
Figure 13A:
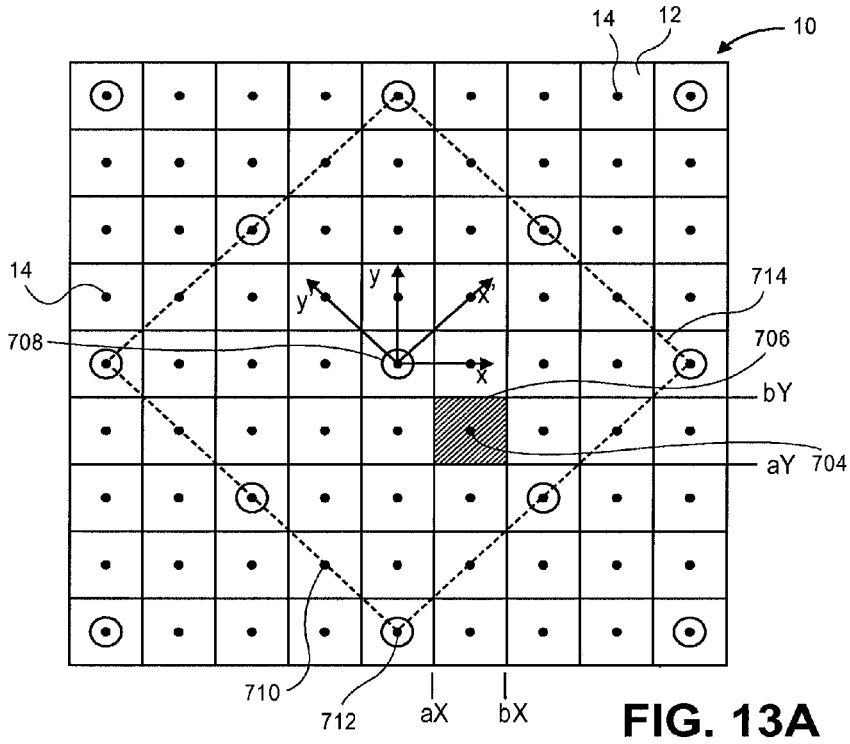
FIG. 13A graphically illustrates the resample area of one resample point overlaid on a grid of input image sample points and their implied sample areas.

FIG. 13A graphically illustrates a portion of input image sample grid 10 of FIG. 1. As in FIG. 1, each input image sample point 14 is illustrated by a black dot and has an implied sample area 12 associated with it; for example, in FIG. 13A, implied sample area 706 containing input image sample point 704 has been shaded by way of example. The x, y co-ordinate system of the input image sample points 14 is indicated in the center of FIG. 13A by the horizontal and vertical lines with arrows respectively labeled x and y.

With continued reference to FIG. 13A, resample points from a portion of resample area array 260 of FIG. 7 are overlaid on input image grid 10 such that the resample points are coincident with input image resample points; each resample point is illustrated in FIG. 13A as a circle around an input image resample point. Resample points, also called reconstruction points, are therefore illustrated in FIG. 13A without the hatching shown in other figures. A single resample area 714 containing resample point 708 is shown in dashed lines in FIG. 13A. With reference to FIG. 7, resample area 714 of FIG. 13A is formed by drawing lines between the resample points 205 in any set of four adjacent resample areas 210 in resample area array 260, with each resample point 205 being at the vertex of a diamond shaped area.

In examining a portion of the tiling pattern of the resample areas in FIG. 7 with respect to the input image sample grid 10 of FIG. 1, it can be seen that the rectangular grid of resample areas is rotated 45 degrees from grid 10 of input image (implied) sample areas 12 formed by input image sample points 14. Thus, resample area 714 has its own x' y' co-ordinate system (also shown in the center of FIG. 13A with its respective labeled directional lines) with axes parallel to the sides of resample area 714. Distances expressed in the x' y' co-ordinate system are used to evaluate the area resample function to produce a luminance value for the subpixel represented by resample point 708. In FIG. 13A, the area resample function is a two-dimensional (2D) function whose value is the product of the 1D area resample function evaluated in both x' and y' diagonal distances from resample point 708. That is, since the resample areas extend in two dimensions when overlaid on an input image sample grid, it is useful to evaluate area resample functions in this two-dimensional frame of reference.

Figure 13B:
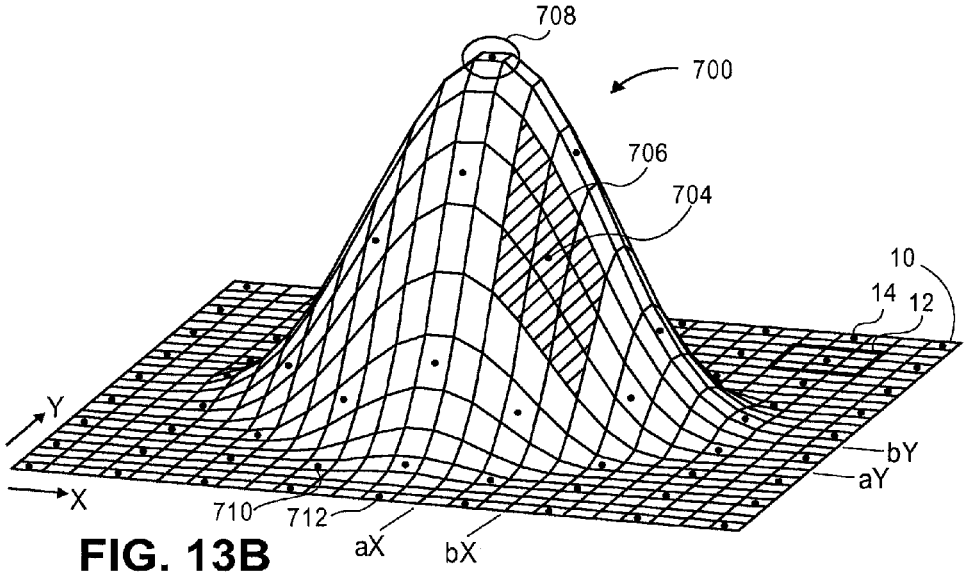
FIG. 13B graphically illustrates the shape of a two dimensional area resample function projected into three dimensions.

FIG. 13B shows the grid of input sample points 14 from FIG. 13A, and further graphically illustrates the shape of a representative 2D area resample function 700. In FIG. 13B, area resample function 700 is constructed from 1D area resample function 500 of FIG. 11A, as expressed in Equation (1) above (i.e., f1(x)=(cos(x)+1)/2)) when function 700 is centered on resample point 708. To construct an area resample filter for resample point 708, the volume under each of the implied sample areas 12 for each of the input sample points 14 that lie within the boundary of the resample area 714 of resample point 708 is calculated. Shaded implied sample area 706 is the implied sample area of input sample point 704. Thus, the volume underneath implied sample area 706 is one coefficient of the area resample filter for resample point 708. The x and y axes of this graph comprise the orthogonal co-ordinate system of input image sample grid 10, and the height of the graph (i.e., the third axis) is the value of the resulting 2D resample function.

Note that the most convenient co-ordinate system to use to calculate these volumes would be the orthogonal x,y co-ordinate system of the input sample points 14. As mentioned above, however, the 2D area resample function is evaluated using diagonal distances expressed as (x', y'). Since the diagonal co-ordinates are rotated 45 degrees, the following equations can translate from one system to another:

$$x' = \frac{x}{\sqrt{2}} + \frac{y}{\sqrt{2}} \qquad \text{Equations (2) and (3)}$$

$$y' = \frac{y}{\sqrt{2}} - \frac{x}{\sqrt{2}}$$

Thus, in the x,y co-ordinate system of the input sample points, the 2D resample function based on the cosine function is expressed as:

$$\left(\cos\left(\frac{x}{\sqrt{2}} + \frac{y}{\sqrt{2}}\right) + 1\right)\cdot\left(\cos\left(\frac{y}{\sqrt{2}} - \frac{x}{\sqrt{2}}\right) + 1\right) \qquad \text{Equation (4)}$$

This is divided by an appropriate constant to make the entire volume of the function sum to one, which is described in more detail below. This area resample function may be evaluated for the range in x and y from zero at reconstruction point 708 to 180°×√2 (the square root of two) at the nearest neighboring resample points in the orthogonal directions.

In the case where the 1D resampling function is an analytical function (such as, for example, Equation (1) above), it is tempting to use analytical methods to calculate these volumes. For example, consider the following definite integral:

$$\int_{ay}^{by}\int_{ax}^{bx}\left(\cos\left(\frac{x}{\sqrt{2}} + \frac{y}{\sqrt{2}}\right) + 1\right)\cdot\left(\cos\left(\frac{y}{\sqrt{2}} - \frac{x}{\sqrt{2}}\right) + 1\right)dx\,dy \qquad \text{Equation (5)}$$

The formula in Equation (5) may be evaluated analytically for any input image sample area to produce the exact volume under the resample function at a particular input image sample point. However, these results must be used with care when one of the constraints on the value of an area resample function is that it should be zero outside the resample area of the resample point being evaluated.

Consider, for example, area resample function 700 in FIG. 13B evaluated for resample point 708 having resample area 714 (FIG. 13A). Recall that the result of evaluating an area resample function is an image filter kernel with a set of coefficients. In the case of resample area 714, the resulting filter kernel may be viewed as a 9×9 matrix of coefficients such that each coefficient in the matrix represents a respective one of the input image sample areas shown in FIG. 13A. The following methods ensure that area resample function 700 is zero outside resample area 714:

(1) force the value of the function to zero for an input image sample point outside resample area 714, such as input image sample point 14;

(2) divide the value of the function by two for an input image sample point on the edge of resample area 714, such as input image sample point 710; and (3) divide the value of the function by four for an input image sample point on the corner of resample area 714, such as input image sample point 712.

These measures are useful because the 1D resample function is never actually analytical. Even the example of the cosine function is really a piece-wise non-analytical function composed of a single cycle of the cosine function which is then combined with a zero function all around it. This is shown in FIG. 13B as the flat area all around the central raised portion of the area resample function.

Thus, in some applications, it may be preferable to compute a numerical approximation for the value of the area resample function. If numerical methods are used to calculate the volumes, then the piecewise linear functions illustrated in the graphs of FIGS. 8A, 9A and 10 are as acceptable as area resample functions as the cosine function of FIG. 11A. In fact, as long as the area resample function meets the requirement of maintaining color balance, it may be used as an area resample function to generate filter coefficients, even if it is partially or wholly non-linear, contains discontinuities (such as bi-valued function 100 in FIG. 8A), is drawn by hand or produced with the help of a computer program. An example of a function that maintains color balance is one that will have, for example, the four characteristics enumerated above.

FIG. 13B suggests one way to calculate filter coefficients numerically. Note that the grid lines in FIG. 13B are drawn at three times the precision of the actual resample areas 12 of FIG. 13A. That is, except for the implied sample areas of the input image sample points 14 at the edge of grid 10, each input image sample area 12 of FIG. 13A is represented in FIG. 13B as a set of 3-by-3 rectangles. This level of precision more easily shows the curved shape of area resample function 700. Implied resample area 706 is represented as 9 small rectangles having 16 distinct computation points. The average height of these 16 computation points may be used as an approximation of the volume under the resample area. The number of points in the grid may be increased to calculate a more accurate volume, if necessary. This procedure is performed for all of the input image sample areas of FIG. 13B and the resulting numbers are scaled until the whole volume of the filter sums to one.

Figure 14A:
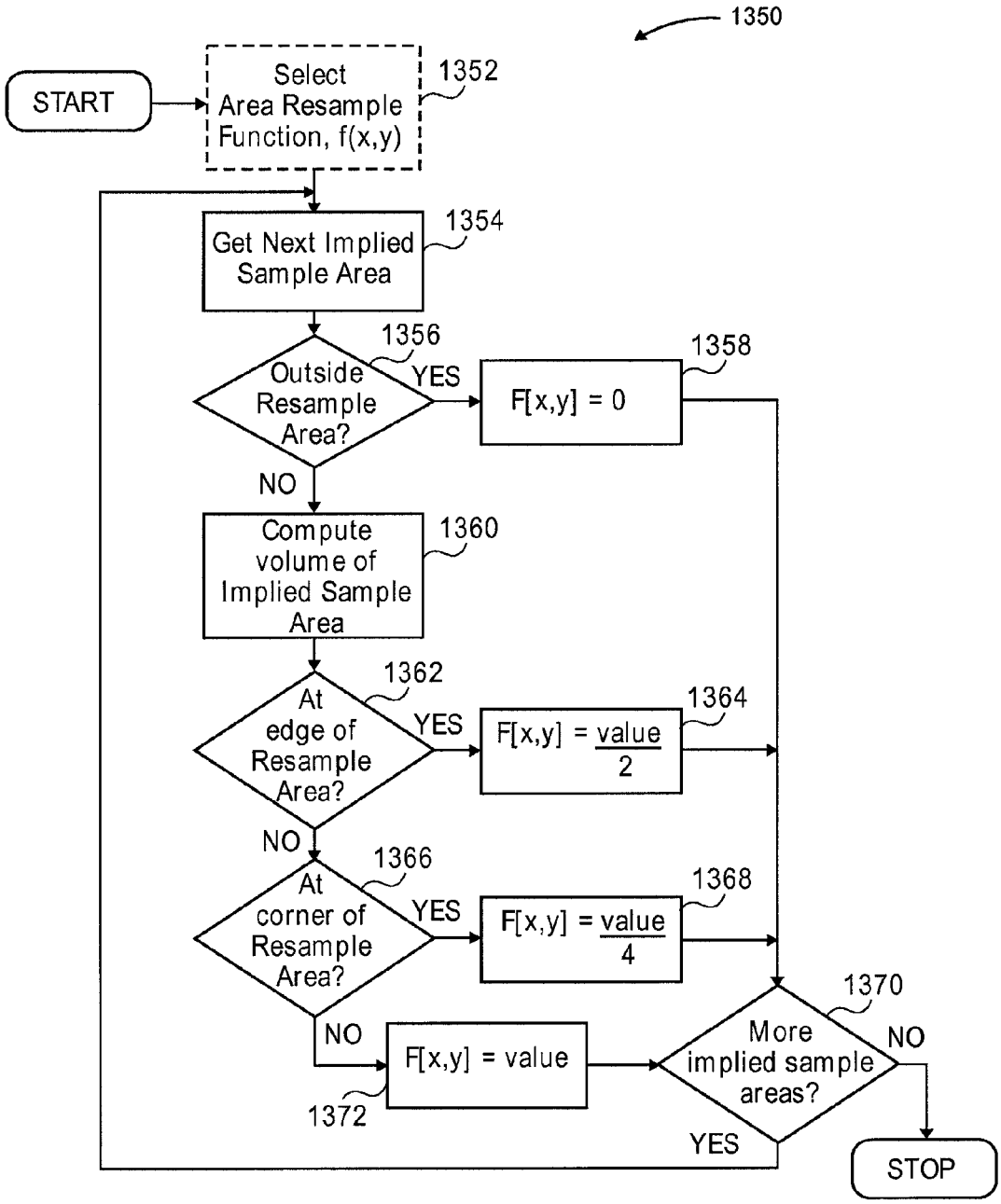
FIG. 14A is a flowchart depicting a routine for computing the coefficient values for an area resample filter kernel for a two dimensional area resample function such as the function illustrated in FIG. 13B.

FIG. 14A is a flow chart illustrating an embodiment of a routine 1350 for computing the coefficients of a filter kernel for a given reconstruction point in a primary color array. The resulting coefficients are stored in a table F(x,y). Routine 1350 accepts as input the (x,y) location in the input image sample grid 10 of the reconstruction point being evaluated. Routine 1350 may also optionally accept the (x,y) locations of all of the neighboring reconstruction points, or alternatively may compute those locations from the given (x,y) location of the reconstruction point. Routine 1350 may also optionally use an input parameter setting to select an area resample function, f(x,y) (shown as being optional in box 1352 having a dashed line outline) to use to produce the filter kernel coefficients. Alternatively, routine 1350 may be configured to evaluate a specific area resample function, such as any one of the functions illustrated in FIGS. 9A, 10 and 11A, or any other area resample function that meet the requirements of an acceptable area resample function as described elsewhere herein. In the processing loop from boxes 1354 through 1370, the volume of each implied sample area under function f(x,y) in an area surrounding the given reconstruction point is computed, in box 1360, using, for example, the numerical methods described above. The test in box 1356 first checks to see whether the implied sample area is entirely outside the resample area for the given reconstruction point, in which case, the value of the coefficient F[x,y] is forced to zero, in box 1358. The tests in boxes 1362 and 1364 respectively check whether the implied sample area is at the edge or corner of the resample area. As discussed above, the value of the coefficient F[x,y] at these locations may be further modified, as shown by way of example in boxes 1364 and 1368. If none of the tests is successful, then the implied sample area lies completely inside the resample area and the unmodified value is stored as the coefficient F[x,y] in box 1372. Routine 1350 produces an image filter kernel F[x,y] with one coefficient value for each implied sample area computed using the area resample function. Routine 1350 may also include a final step, not shown in FIG. 14A, in which floating point numbers that express the coefficient values are converted to integers, as described below in the discussion accompanying Table 3.

Table 2 below is an example of an image filter kernel F[x,y] for reconstruction point 708 of FIG. 13A computed using area resample cosine function 500 of FIG. 8A, as graphically represented in FIG. 13B, and illustrated in the flowchart of FIG. 14A.

TABLE 2

| | | | | | | | | |
|---|---|---|---|---|---|---|---|---|
| 0 | 0 | 0 | 0 | 0.000008 | 0 | 0 | 0 | 0 |
| 0 | 0 | 0 | 0.000787 | 0.003349 | 0.000787 | 0 | 0 | 0 |
| 0 | 0 | 0.001558 | 0.017183 | 0.03125 | 0.017183 | 0.001558 | 0 | 0 |
| 0 | 0.000787 | 0.017183 | 0.060926 | 0.087286 | 0.060926 | 0.017183 | 0.000787 | 0 |
| 0.000008 | 0.003349 | 0.03125 | 0.087286 | 0.118737 | 0.087286 | 0.03125 | 0.003349 | 0.000008 |
| 0 | 0.000787 | 0.017183 | 0.060926 | 0.087286 | 0.060926 | 0.017183 | 0.000787 | 0 |
| 0 | 0 | 0.001558 | 0.017183 | 0.03125 | 0.017183 | 0.001558 | 0 | 0 |
| 0 | 0 | 0 | 0.000787 | 0.003349 | 0.000787 | 0 | 0 | 0 |
| 0 | 0 | 0 | 0 | 0.000008 | 0 | 0 | 0 | 0 |

Figure 19:
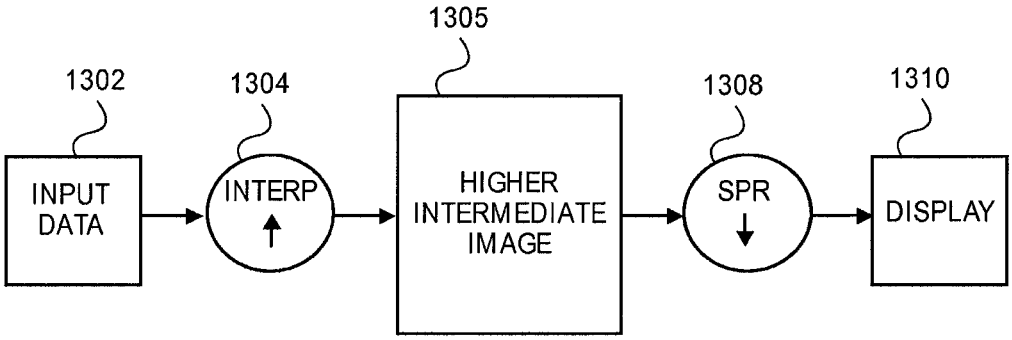
FIG. 19 is a block diagram showing functional processing components that may be used to reduce moiré in a display system.

The values in exemplary Table 2 reflect the choice of a particular ratio of input samples to output resample points. In particular, in the example of the area resample cosine function 700 shown in FIGS. 13A and 13B, the linear ratio of input samples to output resample points has been chosen to be 2:1. An environment in which the number of input samples is larger than the number of resample points in the output may be referred to as a "supersampling" environment. In a supersampling environment, the source image data may already represent an image that is larger than the size of the output display panel. Alternatively, the source image data may be upsampled by any known method to a higher intermediate image before the subpixel rendering operation is performed, such as shown in FIG. 19. The area resample techniques discussed herein will work equally as well with input to output ratios larger than the ratio of 2:1.

For practical software and hardware implementations of filter kernels such as the filter kernel F[x,y] represented in Table 2, the floating point numbers may be replaced with approximations to an arbitrary bit depth. Table 3 below and FIG. 14B shows an example of such a replacement filter kernel 1450, with values converted to 11-bit fixed point binary fractions, which are shown in Table 3 as decimal numbers. These numbers are computed by multiplying each floating point value by 2048 and truncating the result to an integer value. As described in U.S. Pat. No. 7,123,277, the truncation of the floating point values in Table 2 to the integer values in Table 3 may be done in such a way that the values in the filter kernel in Table 3 sum to "one," or the divisor 2048 in this case.

TABLE 3

| | | | | | | | | |
|---|---|---|---|---|---|---|---|---|
| 0 | 0 | 0 | 0 | 0 | 0 | 0 | 0 | 0 |
| 0 | 0 | 0 | 1 | 7 | 1 | 0 | 0 | 0 |
| 0 | 0 | 3 | 35 | 64 | 35 | 3 | 0 | 0 |
| 0 | 1 | 35 | 125 | 180 | 125 | 35 | 1 | 0 |
| 0 | 7 | 64 | 180 | 244 | 180 | 64 | 7 | 0 |
| 0 | 1 | 35 | 125 | 180 | 125 | 35 | 1 | 0 |
| 0 | 0 | 3 | 35 | 64 | 35 | 3 | 0 | 0 |
| 0 | 0 | 0 | 1 | 7 | 1 | 0 | 0 | 0 |
| 0 | 0 | 0 | 0 | 0 | 0 | 0 | 0 | 0 |

The choice of converting these values to 11-bit fixed point binary fractions was chosen because the resulting values in the filter kernel of Table 3 contains no numbers larger than 255. This allows the filter kernel to be stored in software tables or hardware as 8-bit numbers, which saves gates despite the fact that 11 bits of precision are calculated. The filter kernel in Table 3 or FIG. 14B is used as a filter that is convolved with the input sample point values around each resample point, and then divided by 2048 to calculate the subpixel rendered output value for each resample point. Note that truncating the table to 11 bits results in zeros around the periphery of the table. This would allow the optimization of using a smaller filter table.

When expanding the resample function to two dimensions as described above with respect to the cosine function of FIGS. 13A, 13B and 14A, the arrangement of the reconstruction points is taken into consideration, and the "overlapping" property of the function, as described above in conjunction with FIGS. 18A, 18B and 18C, influences how input image sample areas are processed. For the case of a display panel substantially comprising the RGBW subpixel repeating group 3 or 9 in FIGS. 5A and 5B, the color reconstruction points for a primary color are substantially on a square or rectangular grid. See for example the red color plane 260 for RGBW subpixel repeating group 3 or 9 in FIGS. 5A and 5B as shown in FIG. 7. Reconstruction point 101 is in the center of the square formed by the four nearest neighbor reconstruction points 105 and 109. The area resample function may be zero at the lines connecting the nearest neighbor reconstruction points 105 with the next nearest (diagonal) neighbor reconstruction points 107. As shown in FIGS. 13A and 13B, the area resample function may evaluate to a zero value along the line of reconstruction points ending at point 712. In this configuration, any given input image sample point in the source image data may not be coincident with a reconstruction point of the color plane being reconstructed, or may not be coincident with the lines connecting the reconstruction points of the color plane being reconstructed. When the primary color subpixels are positioned substantially on a square or rectangular grid, such an input image sample point is evaluated by (or mapped to) four overlapping resample functions that preferably sum to a constant, which in one embodiment, may be one (1). One manner of expanding the resample function to two dimensions is to multiply the values of the projected orthogonal functions running from the center to the nearest neighbors. For example, the instantaneous value of the area resample function at the mid-point, equidistant from four reconstruction points, may be 0.5×0.5=0.25. There will be a total of four overlapping functions giving the same value, which would sum to one.

Figure 21:
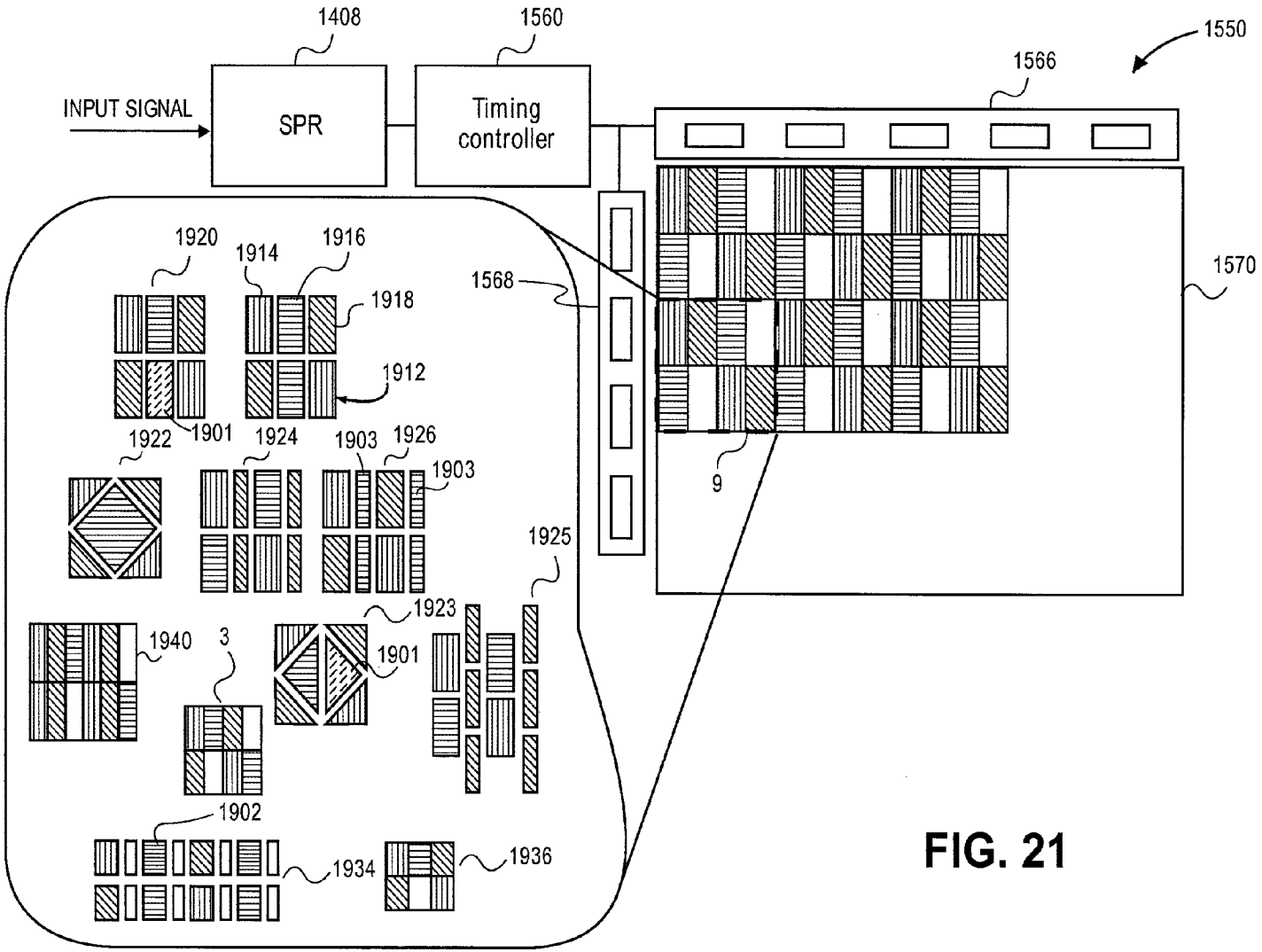
FIG. 21 is a block diagram of a display device architecture and schematically illustrating simplified driver circuitry for sending image signals to a display panel comprising one of several embodiments of a subpixel repeating group.

For the case of a display panel substantially comprising the sixteen subpixel RGBCW repeating group 1934 in FIG. 21, the color reconstruction points for a primary color are substantially on a hexagonal grid. That is, each reconstruction point in the color plane for one of the saturated primary colors occurs at the center of a hexagon and has six nearest neighbor reconstruction points. The two dimensional function may be zero at the lines that connect each of the six nearest neighbor reconstruction points to another nearest neighbor reconstruction point. The linear function may be normalized to the distance from the center to the lines connecting the six nearest neighbors. In this configuration, a given input image sample point in the source image data may not be coincident with a reconstruction point of the saturated primary color plane being reconstructed, or may not be coincident with the lines connecting the nearest neighboring reconstruction points. Such a given input image sample point is mapped to three overlapping resample functions that sum to a constant, for example, to one (1). For example, the instantaneous value of the area resample function at the mid-point, equidistant from three reconstruction points may be one-third, which would sum to one since there are three overlapping functions of the same value.

Sharpening Filters

In very general terms, a sharpening filter moves luminance energy from one area of an image to another. Sharpening filters have been previously discussed in commonly-owned US 2005/0225563, and in other commonly-owned patent application publications referenced herein, and are briefly illustrated in Table 1 above. A sharpening filter may be convolved with the input image sample points to produce a sharpening value that is added to the results of the area resample filter. If this operation is done with the same color plane, the operation is called self sharpening. In self-sharpening, the sharpening filter and the area resample filter may be summed together and then used on the input image sample points, which avoids the second convolution. If the sharpening operation is done with an opposing color plane, for example convolving the area resample filter with the red input data and convolving the sharpening filter with the green input data, this is called cross-color sharpening. Cross-color sharpening has advantages for certain types of subpixel repeating groups, such as, for example, subpixel repeating groups in which red and green subpixels are arranged in a substantially checkerboard pattern. In subpixel rendering operations in which a separate luminosity channel is calculated, such as subpixel repeating groups 3 or 9 in FIG. 5A or 5B, the sharpening filter is convolved with this luminance signal; this type of sharpening is called cross luminance sharpening.

Figure 15:
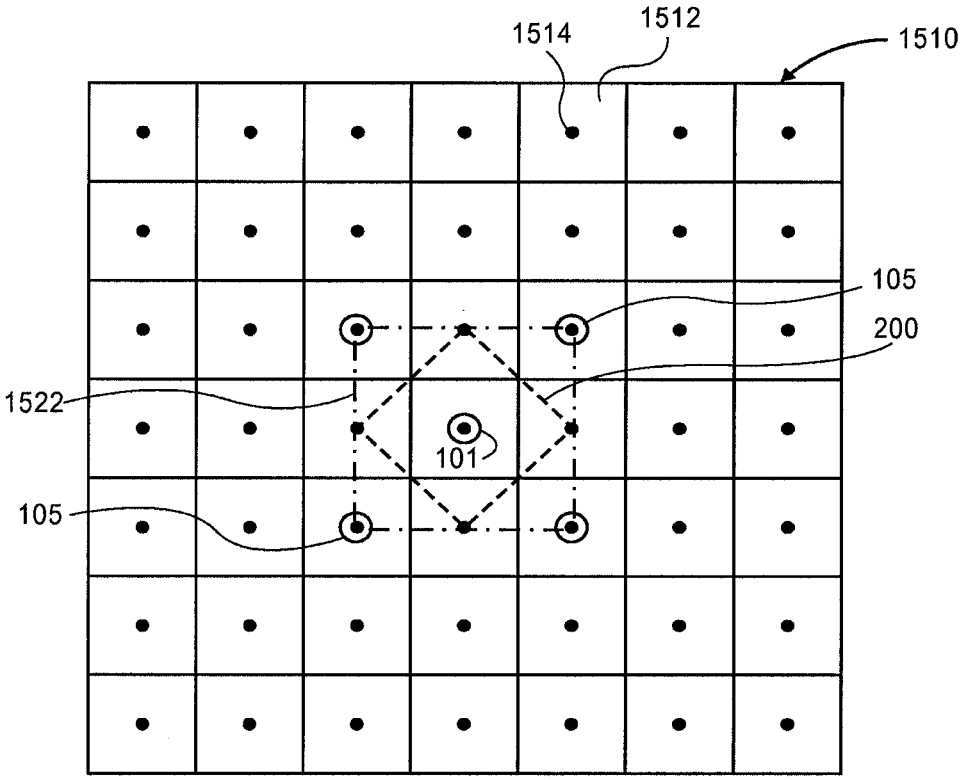
FIG. 15 graphically illustrates a grid of input image sample points and their implied sample areas on which is overlaid a first embodiment of outer and inner function areas for use in computing a Difference of Gaussians sharpening filter.

The technique for producing a sharpening filter for use with known area resample filters of the type illustrated in FIG. 8A is briefly summarized here with reference to FIG. 15. FIG. 15 shows input image sample grid 1510 comprised of input image sample points 1514, each illustrated by a black dot, with their associated implied sample areas 1512. In the embodiment shown in FIG. 15, the resample (reconstruction) points of resample area array 260 of FIG. 7 are mapped to the set of input image sample points 1514 with their associated implied sample areas 1512 at the ratio of 1:1, or one input image pixel to one reconstruction point. Each resample point is illustrated as a circle around an input image resample point. Resample area 200 from FIG. 7 with its associated resample point 101 is overlaid on input image grid 1510 as shown. Resample area 200 overlaps five (5) implied sample areas 1512. Generating an area resample filter using the area ratio principles of area resampling as described in the discussion of exemplary subpixel rendering operations disclosed in U.S. Pat. No. 7,123,277 and in US 2005/0225563 produces the area resample filter:

| | | |
|---|---|---|
| 0.0 | 0.125 | 0.0 |
| 0.125 | 0.5 | 0.125. |
| 0.0 | 0.125 | 0.0 |

With continued reference to FIG. 15, the polygonal area bounded by dashed line 1522 represents an outer area function that is formed by connecting the closest resample points in resample area array 260 of FIG. 7. Two of these closest resample points happen to include resample points 105 illustrated in FIGS. 7 and 8A. The polygonal-shaped outer area representing the outer area function will be referred to as sharpening area 1522. Sharpening area 1522 overlaps nine (9) implied sample areas 1512. Applying the same area ratio principles used in area resampling as disclosed in U.S. Pat. No. 7,123,277 and in US 2005/0225563 produces the sharpening filter:

| | | |
|---|---|---|
| 0.0625 | 0.125 | 0.0625 |
| 0.125 | 0.25 | 0.125 |
| 0.0625 | 0.125 | 0.0625 |

A second filter referred to as an approximate Difference Of Gaussians (DOG) wavelet filter is computed by subtracting (e.g. by taking the difference) the outer sharpening area filter kernel from the inner area resample filter kernel. In effect, this operation subtracts the value of the area resample function enclosed in the resample area defined by boundary 200 from the outer area function enclosed in the area defined by boundary 1522, to produce the DOG Wavelet filter, reproduced below (and shown above in Table 1):

| | | |
|---|---|---|
| −0.0625 | 0.0 | −0.0625 |
| 0.0 | 0.25 | 0.0 |
| −0.0625 | 0.0 | −0.0625 |

Note that the coefficients of the DOG wavelet filter typically sum to zero.

A similar operation may be performed when the area resample filter is one of the expanded area resample filters of the type discussed and illustrated above in FIGS. 9A, 10 and 11A. In one embodiment, when a cosine function of the type illustrated in FIGS. 11 and 13B is used for both the area resample function and the outer area function, the resulting filter is called a Difference Of Cosine or DOC filter.

Figure 12A:
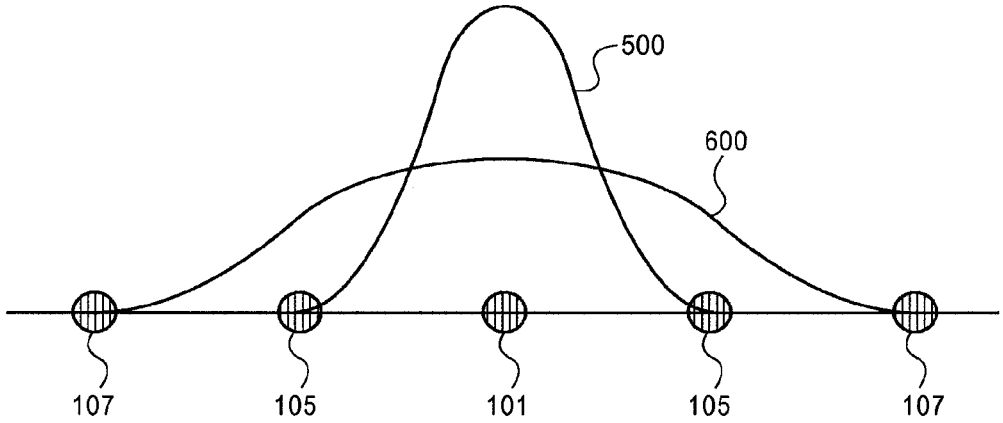
FIG. 12A graphically illustrates cross sections of the area resample cosine function of FIG. 11A and a second area resample cosine function, each of which may be used to compute the luminance value at an exemplary resample point at a cross-section of the resample area array of FIG. 7.
Figure 12B:
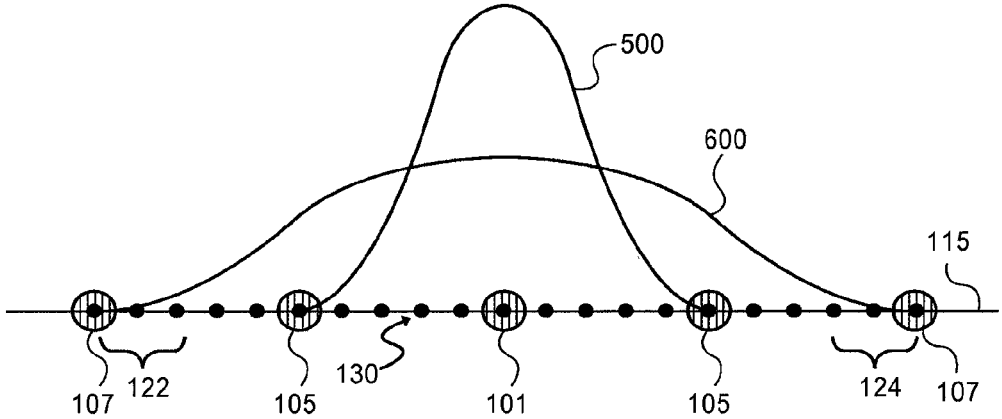
FIG. 12B graphically illustrates the two area resample cosine functions of FIG. 12A overlaying input image data samples for an exemplary resample point.
Figure 12C:
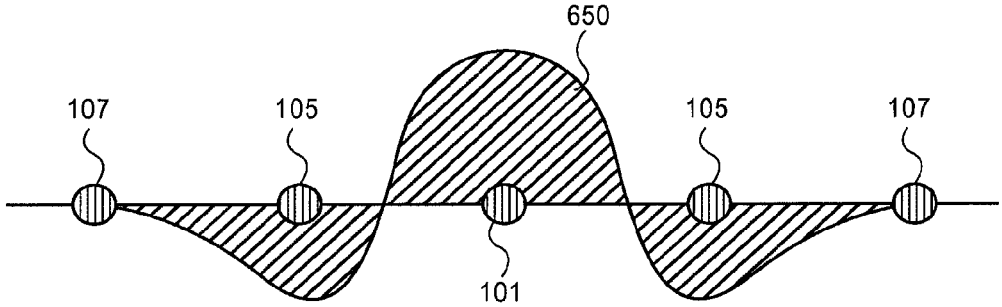
FIG. 12C shows a cross section of a Difference of Cosines filter computed from the two cosine functions of FIG. 12A.

FIGS. 12A, 12B and 12C graphically illustrate the generation of the DOC function, in the one-dimensional view of these figures, showing that the cosine function may serve as a close approximation for a windowed Difference of Gaussians (DOG) function generator in which a narrower area cosine function is subtracted from a wide area cosine function having the same integral.

FIG. 12A illustrates outer area cosine function 600, defined by the function $$f2(x)=(\cos(x/2)+1)/4, \qquad \text{Equation (6)}$$

where f2(x) is evaluated from x=−360° to +360°. FIG. 12A also illustrates narrower area resample cosine function 500 of Equation (1) above, which is evaluated from x=−180° to +180°. In very general terms, outer area cosine function 600 produces a sharpening filter using input image sample values that extend to reconstruction points 107. At neighboring reconstruction points 105 in the same primary color plane, outer area cosine function 600 has approximately half of the peak value of area resample cosine function 500 at reconstruction point 101. Outer area cosine function 600 reaches zero as it reaches the next set of near neighbor reconstruction points 107 (FIG. 7) in the primary color plane. FIG. 12B illustrates area resample cosine function 600 of FIG. 12A with a set of input image sample points 130, represented by the black dots along baseline 115, mapped onto the reconstruction points 107, 105 and 101.

FIG. 12C graphically illustrates a Difference of Cosines (DOC) function 650, hereafter called DOC filter 650, resulting from subtracting area resample cosine function 500 from outer area cosine function 600. Equation (3) below shows the computation.

$$f_{DOC}(x)=f1(x)-f2(x)=(\cos(x)+1)/2-(\cos(x/2)+1)/4. \qquad \text{Equation (7)}$$

As illustrated in FIGS. 12 A, B and C, the general steps for producing DOC filter 650 for an expanded area resample function of the type described in the illustrated embodiments herein include:

(1) computing the area resample filter using the area resample cosine function;

(2) computing the outer area sharpening filter using the outer area cosine function; and (3) subtracting the inner area resample filter from the outer sharpening filter.

Figure 16:
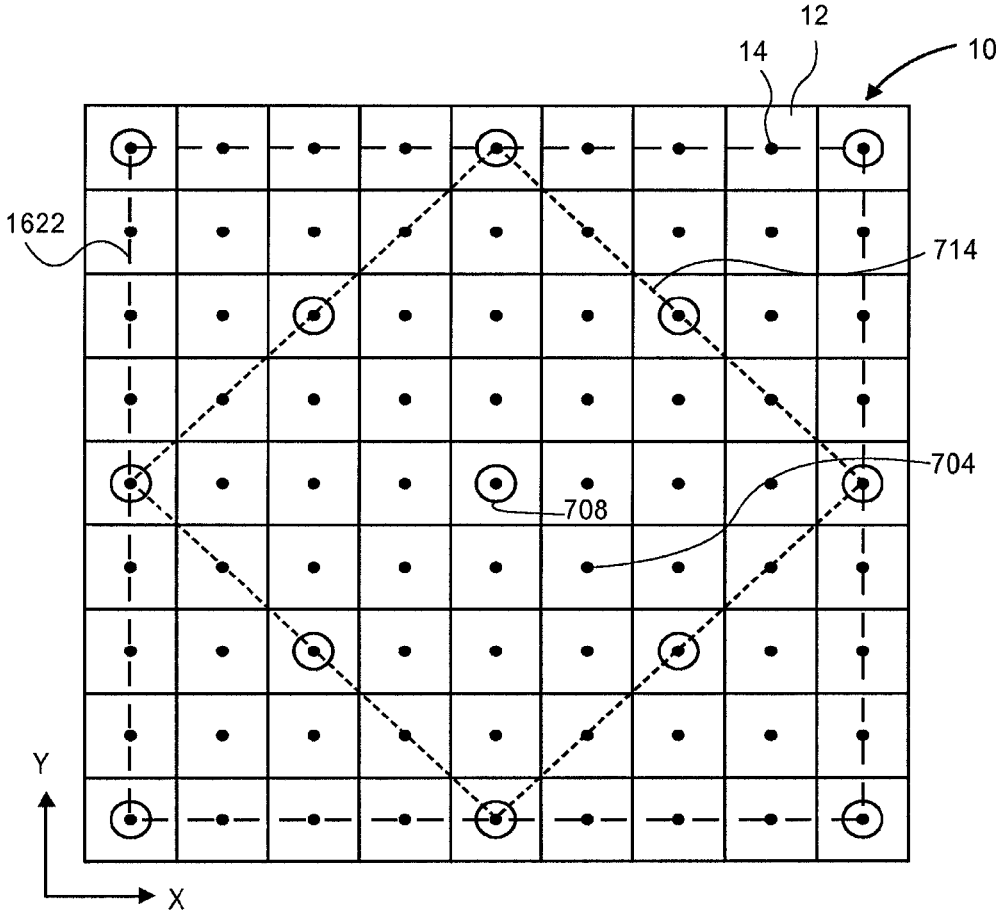
FIG. 16 graphically illustrates a grid of input image sample points and their implied sample areas on which is overlaid a set of resample points, some of which form a second embodiment of outer and inner function areas for use in computing a Difference of Cosines sharpening filter.

FIG. 16 graphically illustrates the technique for producing the DOC filter in the 2D frame of reference. Resample points from a portion of resample area array 260 of FIG. 7 overlaid on input image sample grid 10 of FIG. 13A such that the resample points are coincident with input image resample points. As in FIG. 13A, each input image sample point 14 is illustrated by a black dot and has an implied sample area associated with it. Each resample point is illustrated as a circle around an input image resample point. Resample area 714 containing central resample point 708 is again shown in dashed lines and is the resample area formed by area resample cosine function 500 of FIG. 11A. The lines with arrows indicating the x, y co-ordinate system of the input image sample points and the x', y' co-ordinate system of resample area 714 are the same as in FIG. 13A but are omitted from FIG. 15.

As discussed in conjunction with FIG. 13A, the area resample function now extends to the boundary of dashed line 714. To define an outer area function for the sharpening filter, boundary lines are drawn between the resample points that are outside resample area 714 and nearest to resample point 708 so as to generate a polygonal area that completely encloses resample area 714. In FIG. 16, dashed line 1622 denotes the boundary of the outer area function and the area it encloses will be referred to as sharpening area 1622.

The outer area filter is computed in a manner similar to that described above with respect to the area resample filter for area resample function 500 in FIGS. 13A and 13B, and as shown in the flowchart of routine 1350 in FIG. 14. First, the shape of the outer area function is selected. The function shape may be chosen to be the same as that used for the area resample function. So, for example, if area resample cosine function 500 (FIGS. 11A and 13B) is used, then the outer area function may also be a cosine function. However, there may be advantages to using a function shape for the outer area function that is different from the function shape used for the area resample function. For purposes of illustration herein, in the embodiment described in conjunction with FIG. 16, the same function, i.e., the cosine function of Equation (1), is used for both the outer area and area resample functions to generate the area filter kernels. The outer area function is then expanded to be a 2D function. In FIG. 16, sharpening area 1622 which denotes the outer area function has vertical and horizontal boundary lines that are parallel to the orthogonal x, y system of the input image sample grid 10, and computations using the rotated x', y' coordinate system are unnecessary. In the embodiment in which the cosine function is used, the 2D cosine function, denoted as f2, is defined as $$f2(x,y)=(\cos(x)+1)*(\cos(y)+1) \qquad \text{Equation (8)}$$

where x and y ranges from zero at the center reconstruction point 708 to 180 degrees at the edges of outer function area 1622. The next step in computing the coefficients for the filter kernel for sharpening area 1622 is to calculate or approximate the volume under every implied sample area, as was described above in the discussion accompanying FIG. 13B. Finally, the resulting volumes are scaled so that the coefficients in the entire filter sum to one.

The filter kernel for the outer area function produced by the technique just described is then subtracted from the filter kernel computed from the area resample function. For example, the filter kernel computed for the outer area function may be subtracted from the exemplary filter kernel for area resample function cosine 500 illustrated in Table 3. An example of filter kernel produced by this process is shown below in Table 4. The resulting table has positive and negative values that sum to zero. For practical hardware or software implementations, this table is converted to fixed point numbers and stored as integers, taking care that the sum of the filter kernel coefficients still equals zero.

TABLE 4

| | | | | | | | | |
|---|---|---|---|---|---|---|---|---|
| 0 | 0 | 0 | −1 | −1 | −1 | 0 | 0 | 0 |
| 0 | −3 | −10 | −15 | −13 | −15 | −10 | −3 | 0 |
| 0 | −10 | −29 | −19 | 1 | −19 | −29 | −10 | 0 |
| −1 | −15 | −19 | 33 | 72 | 33 | −19 | −15 | −1 |
| −1 | −13 | 1 | 72 | 120 | 72 | 1 | −13 | −1 |
| −1 | −15 | −19 | 33 | 72 | 33 | −19 | −15 | −1 |
| 0 | −10 | −29 | −19 | 1 | −19 | −29 | −10 | 0 |
| 0 | −3 | −10 | −15 | −13 | −15 | −10 | −3 | 0 |
| 0 | 0 | 0 | −1 | −1 | −1 | 0 | 0 | 0 |

The resulting DOC filter, illustrated by way of example in Table 4, can be used in the same manner as the DOG Wavelet filter is used; that is, the DOC filter may be used in self-sharpening, cross-color sharpening and in cross luminance sharpening operations. The technique just described for producing the DOC filter is applicable to the other types of area resample filters discussed and illustrated herein and for area resample functions not explicitly described but contemplated by the above descriptions.

Figure 3:
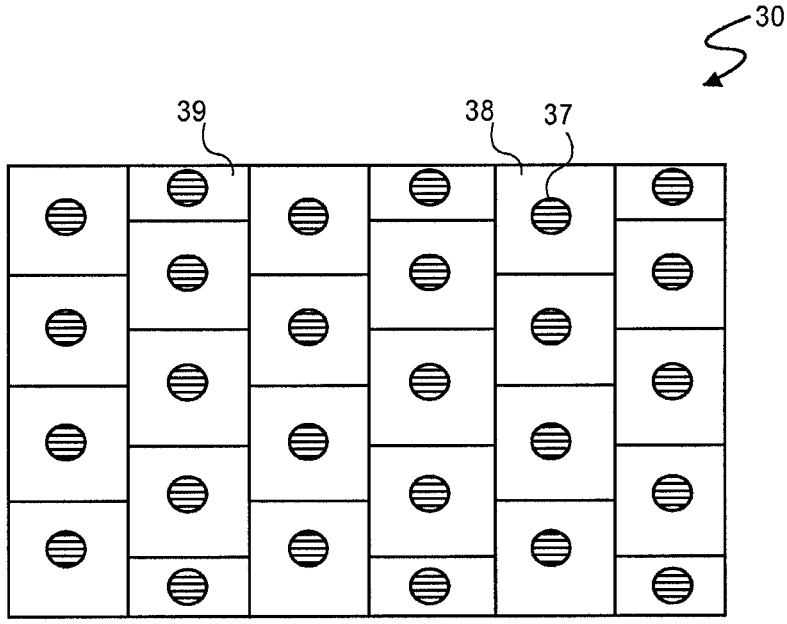
FIG. 3 illustrates a resample area array for a primary color plane of the display panel of FIG. 2, showing reconstruction points and resample areas.
Figure 4:
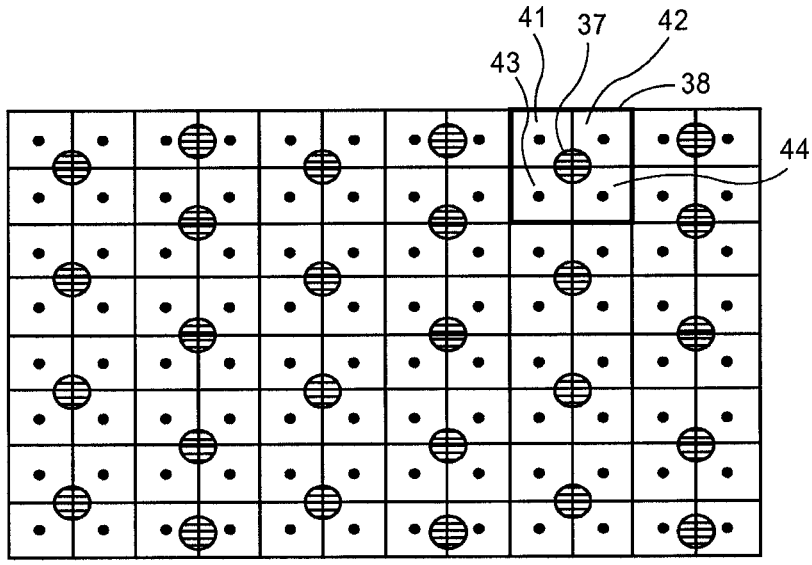
FIG. 4 illustrates the resample area array of FIG. 3 superimposed on the two-dimensional spatial grid of FIG. 1.

In the nomenclature used herein, sharpening filters are distinguishable from metamer sharpening filters. Commonly owned International Application PCT/US06/19657, entitled MULTIPRIMARY COLOR SUBPIXEL RENDERING WITH METAMETRIC FILTERING, discloses systems and methods of rendering input image data to multiprimary displays that utilize metamers to adjust the output color data values of the subpixels. International Application PCT/US06/19657 is published as WO International Patent Publication No. 2006/127555. WO 2006/127555 also discloses a technique for generating a metamer sharpening filter. The sharpening filters described above are constructed from a single primary color plane (e.g., resample array 260 of FIG. 7 or resample array 30 of FIG. 3.) Metamer sharpening filters are constructed from the union of the resample points from at least two of the color planes.

Figure 17:
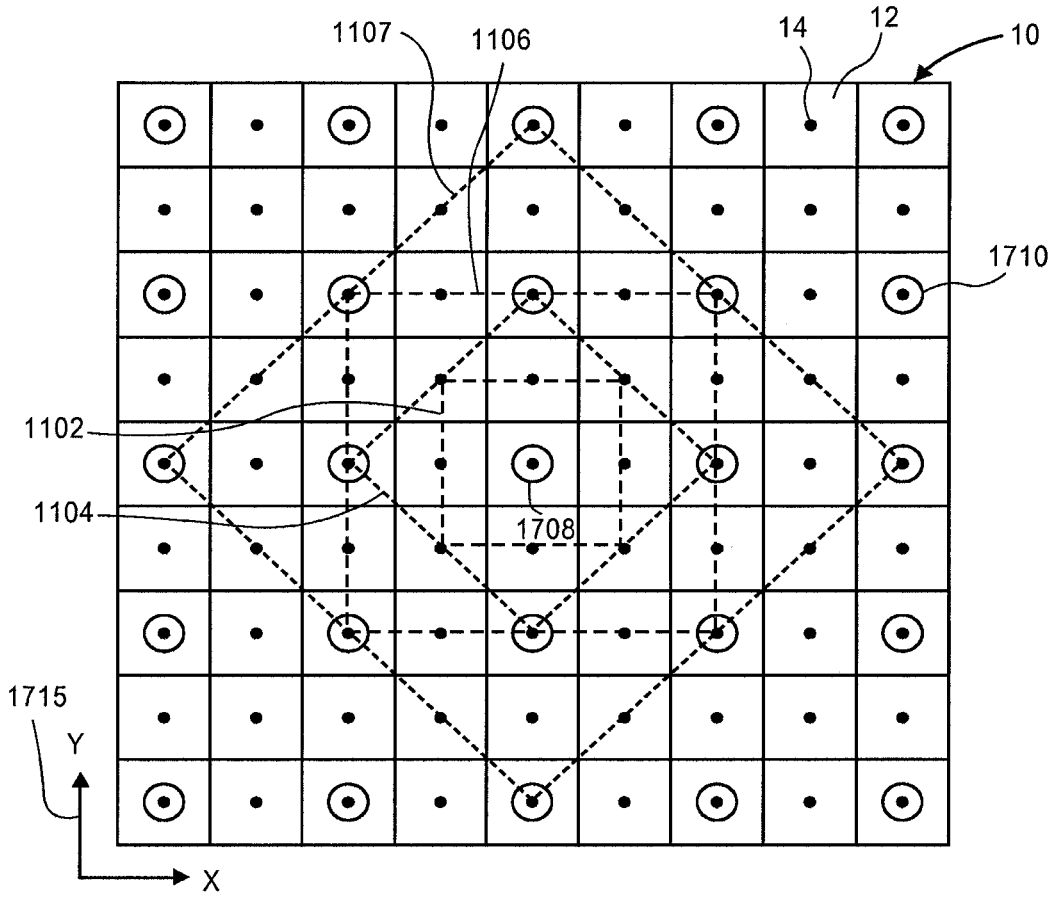
FIG. 17 graphically illustrates a grid of input image sample points and their implied sample areas on which is overlaid resample points from the union of at least two color planes, some of which form first and second pairs of outer and inner function areas for use in computing metamer sharpening filters.

FIG. 17 graphically illustrates input image sample grid 10 comprising a set of input image sample points 14 with their associated implied sample areas 12 overlaid with resample (reconstruction) points 1710 each illustrated as a circle around an input image resample point. As in FIG. 13A, the input image sample areas 12 are mapped to resample points 1710 in a 2:1 ratio. Resample point 1708 is at the center of the grid. FIG. 17 shows more resample points 1710 than are shown in the example in FIG. 13A because, as explained in WO 2006/127555, the union of the resample area arrays for at least two of the saturated primary color subpixels is used in the construction of a metamer sharpening filter. So, for example, if a display panel such as display panel 1570 in FIG. 21 substantially comprises subpixel repeating group 9 of FIG. 5B with saturated primary colors red, green and blue, then the union of at least two of the red, green and blue resample area arrays is used to construct the metamer sharpening filter. In FIG. 17, resample points 1710 for two color planes are shown. As disclosed in WO 2006/127555, a metamer sharpening filter is constructed by subtracting an outer area resample filter defined by diamond-shaped area 1104 from an inner area resample filter defined by square-shaped area 1102.

The expanded area resample functions discussed herein allow for the construction of an expanded metamer sharpening filter by allowing for the use of any suitable area resample function discussed and illustrated herein in conjunction with FIGS. 9A, 10, 11A and 13A and for area resample functions not explicitly described but contemplated by the above descriptions. The area resample filters produced from these expanded area resample functions encompass areas substantially twice as wide as the areas encompassed by the area resample functions described and used in WO 2006/127555. Thus, a metamer sharpening filter constructed using the area resample functions described herein is formed by subtracting an outer area resample filter defined by diamond-shaped area 1107 from an inner area resample filter defined by square-shaped area 1106.

Note that Equation (8) is the 2D version of function $f_{DOC}$ (x) of Equation (7) as illustrated in FIG. 12C. In the context of generating metamer sharpening filters for use in the metamer filtering and subpixel rendering operations described in co-owned patent application publication WO 2006/127555 referenced above, reconstruction points 105 in FIG. 12C may be referred to as metamer opponent reconstruction points 105. DOC function 650 is suitable as a sharpening filter because it has maximal sharpening effect (i.e., it is the most negative) at metamer opponent reconstruction points 105, as can be seen from the illustrated graph of the DOC function 650 in FIG. 12C. With reference to FIG. 12A, this maximum negative effect results because the "wider" area resample cosine function 600 has half value (0.5) as it passes through neighboring reconstruction points 105 of metamer opponent reconstruction point 101. Since the "narrower" area resample cosine function 500 will be reaching zero at neighboring reconstruction points 105 of metamer opponent reconstruction point 101, the value of DOC function 650 will be the most negative at neighboring reconstruction points 105, as one would expect from performing the computation of Equation (7). Area resample cosine function 600 has the same integral as area resample cosine function 500, so that one minus one equals zero integral. Thus the integral of the Difference of Cosines function 650 is zero.

With reference again to FIG. 17, diamond-shaped area 1107 of FIG. 17 encompasses the same area as resample area 714 of FIG. 13A. Despite the fact that the outer area filter for diamond-shaped area 1107 is not used as an area resample filter when constructing the metamer sharpening filter, it may nonetheless be computed in the same manner as the area resample filter is computed for resample area 714. This computation is described above in conjunction with FIGS. 13A and 13B and using the flowchart illustrated in FIG. 14, and produces by way of example the filter kernel shown in Table 3, or the scaled filter kernel of Table 4. Note that this computation uses the rotated x', y' co-ordinate system illustrated in FIG. 13A but not shown in FIG. 17.

Computation of the inner area resample filter defined by square-shaped area 1106 proceeds in a manner similar to that described for the outer area function denoted by square-shaped sharpening area 1622 in FIG. 16. Since square-shaped area 1106 is arranged orthogonally to input image sample grid 10, the x, y co-ordinate system 1715 of the input image sample points is used and use of the rotated co-ordinate system is unnecessary. In the embodiment in which an area resample cosine function is used to compute the inner area resample filter defined by inner square-shaped area 1106, the 2D function for the inner filter is generated in the same manner as described for the sharpening filter in FIG. 16. Computing the inner area resample filter uses the formula of Equation (8) above, where x and y ranges from zero at the center reconstruction point 1708 to 180 degrees at the edges of inner function area 1106. Computing the coefficients for the filter kernel for inner area 1106 involves calculating or approximate the volume under every implied sample area, as was described above in the discussion accompanying FIG. 13B. Finally, the resulting volumes are scaled so that the coefficients in the entire filter sum to one.

Next, the outer area filter kernel is subtracted from the inner filter kernel to produce the metamer sharpening filter. Table 5 below is an exemplary filter kernel for an embodiment of the technique for producing a metamer sharpening filter in which the same function shapes and resolution relationships are used as in the examples of FIGS. 13A and 16.

TABLE 5

| | | | | | | | | |
|---|---|---|---|---|---|---|---|---|
| 0 | 0 | 0 | 0 | 0 | 0 | 0 | 0 | 0 |
| 0 | 0 | 0 | −2 | −7 | −2 | 0 | 0 | 0 |
| 0 | 0 | −3 | −29 | −52 | −29 | −3 | 0 | 0 |
| 0 | −2 | −29 | 3 | 66 | 3 | −29 | −2 | 0 |
| 0 | −7 | −52 | 66 | 220 | 66 | −52 | −7 | 0 |
| 0 | −2 | −29 | 3 | 66 | 3 | −29 | −2 | 0 |
| 0 | 0 | −3 | −29 | −52 | −29 | −3 | 0 | 0 |
| 0 | 0 | 0 | −2 | −7 | −2 | 0 | 0 | 0 |
| 0 | 0 | 0 | 0 | 0 | 0 | 0 | 0 | 0 |

As explained in the commonly-owned WO 2006/127555 publication, the RGBW metamer filtering operation may tend to pre-sharpen, or peak, the high spatial frequency luminance signal, with respect to the subpixel layout upon which it is to be rendered, especially for the diagonally oriented frequencies. This pre-sharpening tends to occur before the area resample filter blurs the image as a consequence of filtering out chromatic image signal components which may alias with the color subpixel pattern. The area resample filter tends to attenuate diagonals more than horizontal and vertical signals. The metamer sharpening filter, whether it be the Difference of Gaussians (DOG) Wavelet filter computed in the manner described in the WO 2006/127555 publication, or the DOC filter computed in the manner described above in conjunction with FIG. 17, may operate from the same color plane as the area resample filter, from another color plane, or from the luminance data plane to sharpen and maintain the horizontal and vertical spatial frequencies more than the diagonals. The operation of applying a metamer sharpening filter may be viewed as moving intensity values along same color subpixels in the diagonal directions while the metamer filtering operation moves intensity values across different color subpixels.

The discussion herein of the expanded area resample cosine functions and metamer sharpening DOC-based filters contemplates that both techniques may be combined in the same embodiment of a subpixel rendering operation (SPR). In such an embodiment that combines a DOC-based SPR with metamer DOC sharpening, it may be best to perform the resample and scaled luminance sharpening centered on the color reconstruction points and the metamer sharpening centered on the reconstruction points for the opposing metameric pairs. For example, for subpixel repeating group 9 of FIG. 5A, an area resample operation may be performed on its own grid for each color plane, red, green, blue, and white, while the metameric sharpening operation may be centered on the white and green reconstruction points. Put another way, the red color plane may be sampled out of phase from the green color plane, but the metamer sharpening value, sampled on the luminance plane and centered on the green subpixel, may be added to the results produced by sampling the red color plane.

The use of the expanded area resample functions, such as the area resample cosine function and the DOC function, may be combined with interpolation of band-limited images to improve the image reconstruction. Such a combination may operate to further reduce the image artifact known as moiré. FIG. 19 shows a diagram of the steps involved in such a procedure. Input data 1302 is first processed through interpolation module 1304 to produce a higher intermediate image 1306 having an intermediate image resolution at some arbitrarily higher level than the resolution of the original image. One example of an interpolation function 1304 is the classic Sinc function from Shannon-Nyquist sampling theory. However, for purposes of cost reduction, a windowed Sinc function or even a simple Catmul-Rom bicubic interpolation function may suffice. In this image reconstruction system, the interpolation may be performed first, to be followed by the combined resampling and sharpening function 1308 using the filter kernels as described herein. Alternatively, the two operations 1304 and 1308 may be convolved to produce the display output 1310 in a single step. Typically, the former two-step method may be considered to be the less computationally intense. But in this case, the convolution may be less computationally intense after the coefficients for the filter kernel indicating the convolution are calculated.

Figure 20A:
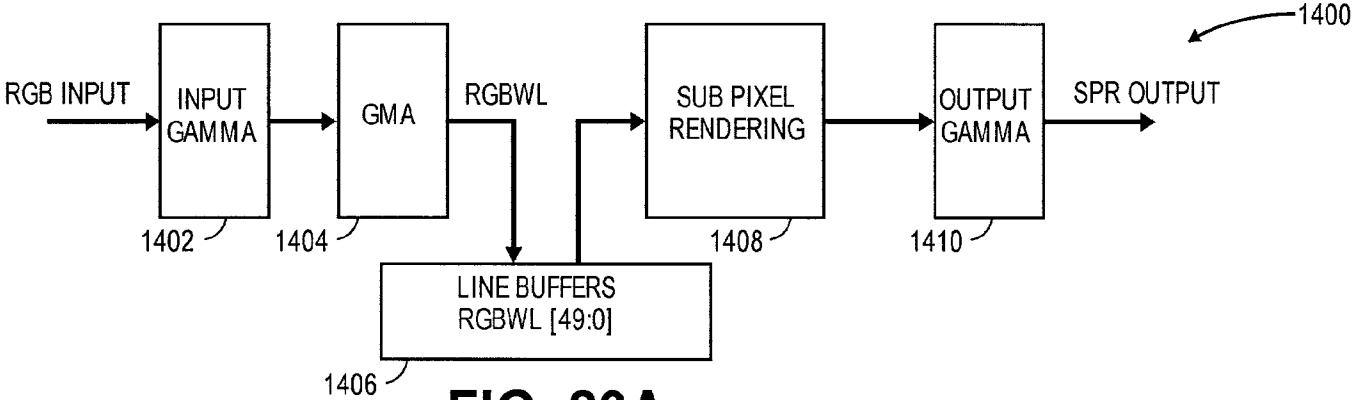
FIGS. 20A and 20B are block diagrams showing the functional components of two embodiments of display devices that perform subpixel rendering operations.
Figure 20B:
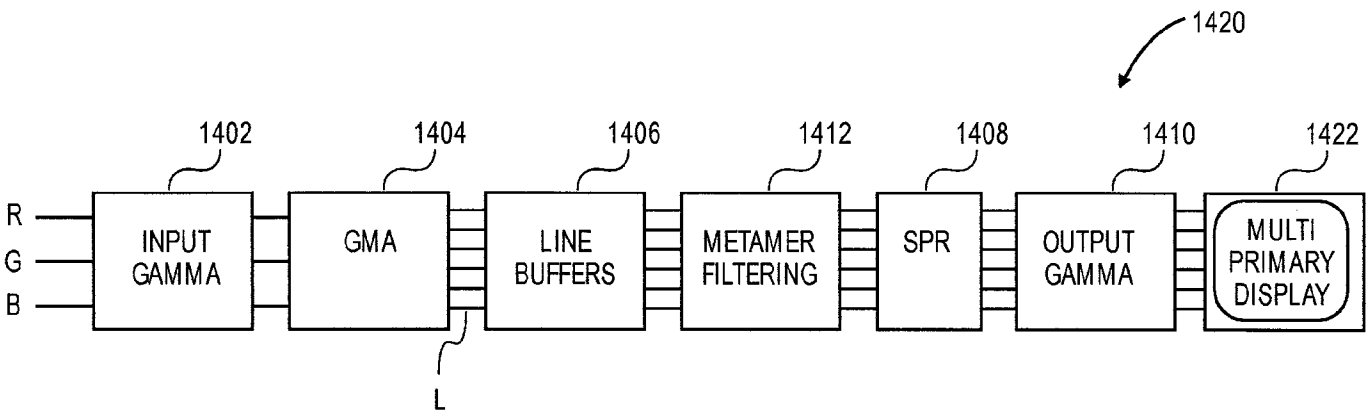

Overview of Display Device Structures for Performing Subpixel Rendering Techniques FIGS. 20A and 20B illustrate the functional components of embodiments of display devices and systems that implement the subpixel rendering operations described above and in the commonly owned patent applications and issued patents variously referenced herein. FIG. 20A illustrates display system 1400 with the data flow through display system 1400 shown by the heavy lines with arrows. Display system 1400 comprises input gamma operation 1402, gamut mapping (GMA) operation 1404, line buffers 1406, SPR operation 1408 and output gamma operation 1410.

Input circuitry provides RGB input data or other input data formats to system 1400. The RGB input data may then be input to Input Gamma operation 1402. Output from operation 1402 then proceeds to Gamut Mapping operation 1404. Typically, Gamut Mapping operation 1404 accepts image data and performs any necessary or desired gamut mapping operation upon the input data. For example, if the image processing system is inputting RGB input data for rendering upon a RGBW display panel, then a mapping operation may be desirable in order to use the white (W) primary of the display. This operation might also be desirable in any general multiprimary display system where input data is going from one color space to another color space with a different number of primaries in the output color space. Additionally, a GMA might be used to handle situations where input color data might be considered as "out of gamut" in the output display space. In display systems that do not perform such a gamut mapping conversion, GMA operation 1404 is omitted. Additional information about gamut mapping operations suitable for use in multiprimary displays may be found in commonly-owned U.S. patent applications which have been published as U.S. Patent Application Publication Nos. 2005/0083352, 2005/0083341, 2005/0083344 and 2005/0225562, all of which are incorporated by reference herein.

With continued reference to FIG. 20A, intermediate image data output from Gamut Mapping operation 1404 is stored in line buffers 1406. Line buffers 1406 supply subpixel rendering (SPR) operation 1408 with the image data needed for further processing at the time the data is needed. For example, an SPR operation that implements the area resampling principles disclosed and described above typically employs a matrix of input (source) image data surrounding a given image sample point being processed in order to perform area resampling. When a 3×3 filter kernel is used, three data lines are input into SPR 1408 to perform a subpixel rendering operation that may involve neighborhood filtering steps. When implementing the area resample functions described herein, including those that use a supersampling regime such as illustrated in FIG. 13A and FIG. 13B, the area resample filter kernels may employ a matrix as large as the 7×7 matrixes in Tables 3 and 5 or the 9×9 matrix in Table 4. These may require more line buffers than shown in FIG. 20A to store the input image data. After SPR operation 1408, output image data representing the output image to be rendered may be subject to an output Gamma operation 1410 before being output from the system to a display. Note that both input gamma operation 1402 and output gamma operation 1410 may be optional. Additional information about this display system embodiment may be found in, for example, commonly owned United States Patent Application Publication No. 2005/0083352. The data flow through display system 1400 may be referred to as a "gamut pipeline" or a "gamma pipeline."

FIG. 20B shows a system level diagram 1420 of one embodiment of a display system that employs the techniques discussed in WO 2006/127555 referenced above for subpixel rendering input image data to multiprimary display 1422. Functional components that operate in a manner similar to those shown in FIG. 20A have the same reference numerals. Input image data may consist of 3 primary colors such as RGB or YCbCr that may be converted to multi-primary in GMA module 1404. In display system 1420, GMA component 1404 may also calculate the luminance channel, L, of the input image data signal—in addition to the other multi-primary signals. In display system 1420, the metamer calculations may be implemented as a filtering operation which utilizes area resample filter kernels of the type described herein and involves referencing a plurality of surrounding image data (e.g. pixel or subpixel) values. These surrounding image data values are typically organized by line buffers 1406, although other embodiments are possible, such as multiple frame buffers. As in the embodiment described in FIG. 20A, filter kernels represented by matrices as large as 9×9 matrices or larger may be employed. Display system 1420 comprises a metamer filtering module 1412 which performs operations as briefly described above, and as described in more detail in WO 2006/127555. In one embodiment of display system 1420, it is possible for metamer filtering operation 1412 to combine its operation with sub-pixel rendering (SPR) module 1408 and to share line buffers 1406. As noted above, this embodiment is called "direct metamer filtering".

FIG. 21 provides an alternate view of a functional block diagram of a display system architecture suitable for implementing the techniques disclosed herein above. Display system 1550 accepts an input signal indicating input image data. The signal is input to SPR operation 1408 where the input image data may be subpixel rendered for display. While SPR operation 1408 has been referenced by the same reference numeral as used in the display systems illustrated in FIGS. 20A and 20B, it is understood that SPR operation 1408 may include any modifications to SPR functions that are discussed herein.

With continued reference to FIG. 21, in this display system architecture, the output of SPR operation 1408 may be input into a timing controller 1560. Display system architectures that include the functional components arranged in a manner other than that shown in FIG. 21 are also suitable for display systems contemplated herein. For example, in other embodiments, SPR operation 1408 may be incorporated into timing controller 1560, or may be built into display panel 1570 (particularly using LTPS or other like processing technologies), or may reside elsewhere in display system 1550, for example, within a graphics controller. The particular location of the functional blocks in the view of display system 1550 of FIG. 21 is not intended to be limiting in any way.

In display system 1550, the data and control signals are output from timing controller 1560 to driver circuitry for sending image signals to the subpixels on display panel 1570. In particular, FIG. 21 shows column drivers 1566, also referred to in the art as data drivers, and row drivers 1568, also referred to in the art as gate drivers, for receiving image signal data to be sent to the appropriate subpixels on display panel 1570. Display panel 1570 substantially comprises a subpixel repeating grouping 9 of FIG. 5A, which is comprised of a two row by four column subpixel repeating group having four primary colors including white (clear) subpixels. It should be appreciated that the subpixels in repeating group 9 are not drawn to scale with respect to display panel 1570; but are drawn larger for ease of viewing.

As shown in the expanded view, display panel 1570 may substantially comprise other subpixel repeating groups as shown. For example, display panel 1570 may also substantially comprise a plurality of a subpixel repeating group that is a variation of subpixel repeating group 1940 that is not shown in FIG. 21 but that is illustrated and described in commonly-owned U.S. patent application Ser. No. 11/342,275. Display panel 1570 may also substantially comprise a plurality of a subpixel repeating group that is illustrated and described in various ones of the above-referenced applications such as, for example, commonly-owned US 2005/0225575 and US 2005/0225563. The area resample functions illustrated and described herein, and variations and embodiments as described by the appended claims, may be utilized with any of these subpixel repeating groups according to the principles set forth herein.

One possible dimensioning for display panel 1570 is 1920 subpixels in a horizontal line (640 red, 640 green and 640 blue subpixels) and 960 rows of subpixels. Such a display would have the requisite number of subpixels to display VGA, 1280×720, and 1280×960 input signals thereon. It is understood, however, that display panel 1570 is representative of any size display panel.

Various aspects of the hardware implementation of the displays described above is also discussed in commonly-owned US Patent Application Publication Nos. US 2005/0212741 (U.S. Ser. No. 10/807,604) entitled "TRANSISTOR BACKPLANES FOR LIQUID CRYSTAL DISPLAYS COMPRISING DIFFERENT SIZED SUBPIXELS," US 2005/0225548 (U.S. Ser. No. 10/821,387) entitled "SYSTEM AND METHOD FOR IMPROVING SUB-PIXEL RENDERING OF IMAGE DATA IN NON-STRIPED DISPLAY SYSTEMS," and US 2005/0276502 (U.S. Ser. No. 10/866,447) entitled "INCREASING GAMMA ACCURACY IN QUANTIZED SYSTEMS," all of which are hereby incorporated by reference herein. Hardware implementation considerations are also described in International Application PCT/US06/12768 published as International Patent Publication No. WO 2006/108084 entitled "EFFICIENT MEMORY STRUCTURE FOR DISPLAY SYSTEM WITH NOVEL SUBPIXEL STRUCTURES," which is also incorporated by reference herein. Hardware implementation considerations are further described in an article by Elliott et al. entitled "Co-optimization of Color AMLCD Subpixel Architecture and Rendering algorithms," published in the SID Symposium Digest, pp. 172-175, May 2002, which is also hereby incorporated by reference herein.

The techniques discussed herein may be implemented in all manners of display technologies, including transmissive and non-transmissive display panels, such as Liquid Crystal Displays (LCD), reflective Liquid Crystal Displays, emissive ElectroLuminecent Displays (EL), Plasma Display Panels (PDP), Field Emitter Displays (FED), Electrophoretic displays, Iridescent Displays (ID), Incandescent Display, solid state Light Emitting Diode (LED) display, and Organic Light Emitting Diode (OLED) displays.

It will be understood by those skilled in the art that various changes may be made to the exemplary embodiments illustrated herein, and equivalents may be substituted for elements thereof, without departing from the scope of the appended claims. Therefore, it is intended that the appended claims include all embodiments falling within their scope, and not be limited to any particular embodiment disclosed, or to any embodiment disclosed as the best mode contemplated for carrying out this invention.

What is claimed is:

1. A display system comprising a source image receiving unit configured for receiving source image data indicating an input image; each color data value in said source image data indicating an input image sample point;

a display panel substantially comprising a plurality of a subpixel repeating group comprising at least two rows of primary color subpixels; each primary color subpixel representing an image reconstruction point for use in computing a luminance value for an output image;

subpixel rendering circuitry configured for computing a luminance value for each image reconstruction point using said source image data and an area resample function centered on a target image reconstruction point; said luminance values computed for each image reconstruction point collectively indicating an output image; at least one of values v1 and v2 respectively computed using said area resample function centered on a first target image reconstruction point and said area resample function centered on a second target image reconstruction point at a common input image sample point between said first and second target image reconstruction points being a non-zero value; and driver circuitry configured to send signals to said subpixels on said display panel to render said output image.

2. The display system of claim 1 wherein said area resample function computes a maximum value for at least one input image sample point; and wherein at least one of values v1 and v2 is less than said maximum value.

3. The display system of claim 1 wherein said values v1 and v2 respectively computed using said area resample function for said first and second target image reconstruction points at said common input image sample point sum to a predetermined constant.

4. The display system of claim 3 wherein said predetermined constant has a value of one (1).

5. The display system of claim 3 wherein said predetermined constant has a value equal to a fixed point binary representation one (1).

6. The display system of claim 3 wherein said predetermined constant has a value equal to a maximum value of said area resample function.

7. The display system of claim 1 wherein said area resample function has a value of zero at a next nearest neighboring image reconstruction point.

8. The display system of claim 1 wherein said area resample function extends to at least two next nearest neighboring image reconstruction points.

9. The display system of claim 1 wherein said area resample function extends to a point equidistant between said first and second target image reconstruction points.

10. The display system of claim 1 wherein said area resample function computes a maximum value for an input image sample point coincident with said target image reconstruction point.

11. The display system of claim 1 wherein said area resample function is a multi-valued linearly decreasing function.

12. The display system of claim 1 wherein said area resample function is a cosine function.

13. The display system of claim 1 wherein said area resample function is a bi-valued function.

14. The display system of claim 1 wherein a plurality of same-colored primary color image reconstruction points form a primary color plane; wherein said subpixel rendering circuitry computes a luminance value for said target image reconstruction points of each said primary color plane.

15. The display system of claim 1 wherein said area resampling function is implemented in said subpixel rendering circuitry as an N×N matrix of filter kernel coefficients such that an N×N set of input image sample points indicating color data values in said source image data is multiplied by said N×N matrix.

16. The display system of claim 15 wherein said N×N matrix of filter kernel coefficients is one of a 7×7 matrix and a 9×9 matrix.

17. The display system of claim 1 wherein said subpixel rendering circuitry is further configured for adjusting said luminance values using an image sharpening filter.

18. The display system of claim 17 wherein said sharpening filter is implemented as a difference-of-cosines (DOC) filter.

19. A display system comprising a source image receiving unit configured for receiving source image data indicating an input image; each color data value in said source image data indicating an input image sample point;

a display panel substantially comprising a plurality of a subpixel repeating group comprising at least two rows of primary color subpixels; each primary color subpixel representing an image reconstruction point for use in computing a luminance value for an output image;

subpixel rendering circuitry configured for computing a luminance value for each image reconstruction point using said source image data and an area resample function centered on a target image reconstruction point; said luminance values computed for each image reconstruction point collectively indicating an output image; said subpixel rendering circuitry being further configured for adjusting at least one of said luminance values using a difference-of-cosines (DOC) sharpening filter; and driver circuitry configured to send signals to said subpixels on said display panel to render said output image.

20. The display system of claim 19 wherein said DOC sharpening filter is computed by subtracting an inner area resample filter for a target reconstruction point computed using an area resample cosine function from an outer area sharpening filter computed using an outer area cosine function centered on said target reconstruction point.

21. The display system of claim 19 wherein said DOC sharpening filter is computed using the function $f_{DOC}(x)=f1(x)-f2(x)=(\cos(x)+1)/2-(\cos(x/2)+1)/4$.

22. The display system of claim 19 wherein said area resample function has a property that, for a common input image sample point between a target reconstruction point and a next nearest neighboring reconstruction point, a value of said area resample function centered on a first reconstruction point at said common input image sample point and a value of an overlapping function centered on a next nearest neighboring reconstruction point at the common input image sample point sum to a constant.

23. A method of producing an output image for rendering on a display panel substantially comprising a plurality of a subpixel repeating group comprising at least two rows of primary color subpixels; each primary color subpixel representing an image reconstruction point for use in computing a luminance value for the output image; the method comprising:

receiving source image data indicating an input image, each color data value in said source image data indicating an input image sample point;

performing a subpixel rendering operation using said source image data and an area resample function centered on a target image reconstruction point; said subpixel rendering operation producing a luminance value for each target image reconstruction point of said display panel such that said luminance values collectively indicate said output image;

performing said subpixel rendering operation further comprising producing values v1 and v2 respectively using said area resample function centered on a first target image reconstruction point and said area resample function centered on a second target image reconstruction point at a common input image sample point between said first and second target image reconstruction points, at least one of said values v1 and v2 being a non-zero value; and sending signals to said subpixels on said display panel to render said output image.

24. The method of claim 23 wherein performing said subpixel rendering operation further comprises multiplying color data values of said input image sample points of said source image data by coefficients of a filter kernel computed for said target image reconstruction point.

25. A computer-implemented method of computing coefficients for an N×N image processing filter for use in a subpixel rendering operation to compute a luminance value for a primary color image reconstruction point using primary color input image sample data values, the method comprising:

receiving a coordinate position of said primary color image reconstruction point relative to an input image grid of input image sample areas, said coordinate position indicating a center of said N×N image processing filter;

determining, by using a filtering module in a display system, a plurality of input image sample areas located within a boundary of a resample area surrounding said primary color image reconstruction point;

for each input image sample area located within said boundary, for an input image sample area entirely located outside said boundary, assigning a coefficient of zero to a position in the N×N image processing filter corresponding to said input image sample area; and for an input image sample area at least partially inside said boundary, computing a value, v, of an area resample function for said input image sample area, said value v being a function of a volume of said input image sample area inside the boundary of the resample area;

for an input image sample area at an edge of said boundary assigning a coefficient of v/2 to a position in the N×N image processing filter corresponding to said input image sample area;

for an input image sample area at a corner of said boundary, assigning a coefficient of v/4 to a position in the N×N image processing filter corresponding to said input image sample area; and for input image sample areas inside said boundary, assigning value v as said coefficient to a position in the N×N image processing filter corresponding to said input image sample area.

26. The computer-implemented method of claim 25 wherein said area resample function is a multi-valued linearly decreasing function.

27. The computer-implemented method of claim 25 wherein said area resample function is a cosine function.

28. The computer-implemented method of claim 25 wherein said area resample function is a bi-valued function.

* * * * *